US008894169B2

(12) United States Patent
Masunaga et al.

(10) Patent No.: US 8,894,169 B2
(45) **Date of Patent: *Nov. 25, 2014**

(54) IMAGE FORMING APPARATUS INCLUDING RECORDING HEAD FOR EJECTING LIQUID DROPLETS

(71) Applicants: Suguru Masunaga, Kanagawa (JP); Takeyuki Kobayashi, Kanagawa (JP)

(72) Inventors: Suguru Masunaga, Kanagawa (JP); Takeyuki Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 33 days.

This patent is subject to a terminal disclaimer.

(21) Appl. No.: 13/667,465

(22) Filed: Nov. 2, 2012

(65) Prior Publication Data

US 2013/0127937 A1 May 23, 2013

(30) Foreign Application Priority Data

Nov. 21, 2011 (JP) ..... 2011-254453

(51) Int. Cl.
*B41J 2/175* (2006.01)

(52) U.S. Cl.
CPC .... *B41J 2/17566* (2013.01); *B41J 2002/17586* (2013.01); *B41J 2002/17516* (2013.01)
USPC ..... 347/6; 347/84; 347/85

(58) Field of Classification Search
USPC ..... 347/6, 84, 85
See application file for complete search history.

(56) References Cited

U.S. PATENT DOCUMENTS

2011/0164077 A1 7/2011 Masunaga
2013/0044148 A1 * 2/2013 Kobayashi ..... 347/6

FOREIGN PATENT DOCUMENTS

JP 5-31915 2/1993
JP 6-183027 7/1994
JP 2005-288932 10/2005
JP 2009-23092 2/2009
WO WO 2011111759 A1 * 9/2011

OTHER PUBLICATIONS

U.S. Appl. No. 13/467,418, filed May 9, 2012, Takeyuki Kobayashi et al.
U.S. Appl. No. 13/517,795, filed Jun. 14, 2012, Suguru Masunaga.

* cited by examiner

*Primary Examiner* — Stephen Meier
*Assistant Examiner* — Alexander D Shenderov
(74) *Attorney, Agent, or Firm* — Cooper & Dunham LLP

(57) ABSTRACT

An image forming apparatus includes an apparatus body, a recording head, a sub tank, a carriage, a main tank, a liquid feed device, a displacement member, a first detector, a second detector, a detection retainer, a liquid consumption amount measuring device, and a supply controller. The measuring device measures a consumption amount of liquid in the sub tank when the displacement member displaces from a first position in a direction in which the consumption amount of liquid in the sub tank decreases. When a detection output of the first detector continues to be, for a predetermined time or number of times, in a detection state in which the first detector detects the displacement member and shifts from the detection state to a non detection state in which the first detector does not detect the displacement member, the measuring device starts measuring the consumption amount of liquid in the sub tank.

17 Claims, 25 Drawing Sheets

IMAGE FORMING APPARATUS INCLUDING RECORDING HEAD FOR EJECTING LIQUID DROPLETS

CROSS-REFERENCE TO RELATED APPLICATIONS

This patent application is based on and claims priority pursuant to 35 U.S.C. §119 to Japanese Patent Application No. 2011-254453, filed on Nov. 21, 2011, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets and a sub tank for supplying liquid to the recording head.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head or liquid-droplet ejection head) for ejecting droplets of ink or other liquid.

The sub tank may have a negative-pressure forming function (mechanism) to create a negative pressure to prevent ink from exuding or dropping from nozzles of the recording head. The sub tank has a negative-pressure forming unit and an air release unit. The negative-pressure forming unit includes a flexible member (film member) to form one face of an ink storage part to store ink and an elastic member to urge the flexible member outward. The air release unit is openably disposed at the sub tank to release the interior of the ink storage part to the atmosphere. Ink is supplied from the ink storage part to the recording head.

The sub tank has a displacement member (also referred to as detection member or detection feeler) to displace with the displacement of the flexible member. When ink is supplied from the main tank to the sub tank with the air release unit of the sub tank opened, i.e., air release filling is performed, the carriage is moved to a predetermined detection position (ink full position) and a driving device of the air release unit disposed at the apparatus body is activated to release the interior of the sub tank to the atmosphere. In such a state, ink filing is started. When a detector disposed at the apparatus body detects the displacement member, the position of the carriage is determined as the ink full position (see JP-2009-023092-A).

In such a case, to allow ink to be replenished and supplied during printing operation, if the consumption amount of ink during printing is a first threshold value or more and it is determined based on information associated with the amount of ink supplied from the main tank to the sub tank during printing that the amount of ink supplied is a second threshold value or less, ink is supplied from the main tank to the sub tank. By contrast, if the amount of ink supplied is greater than the second threshold value, ink is not supplied from the main tank to the sub tank.

Alternatively, instead of the above-described configuration, the sub tank may be provided with a detector for detecting the amount of ink remaining in the sub tank to allow ink supply during printing operation (see JP-3210326-B1 (JP-06-183027-A)).

For the above-described configuration in which the sub tank has the displacement member displaceable with the remaining amount of ink in the sub tank to allow detection of an ink full state of the sub tank, when ink is supplied from the main tank to the sub tank, the carriage need be moved to the predetermined ink full position. As a result, when the remaining amount of ink in the sub tank decreases below a threshold value during printing, the printing need be temporarily stopped for ink supply operation, thus reducing printing speed.

In such a case, for example, by counting the number of ink droplets ejected from the head, the consumption amount of ink in the sub tank may be calculated to supply ink from the main tank by a supply amount corresponding to the consumption amount. However, for such a configuration, since the ink full position is not accurately detected, insufficient ink supply might cause an excessive negative pressure or excessive ink supply might cause an insufficient negative pressure. For this reason, the carriage need be regularly moved to the ink-full detection position to perform the air release filling. As a result, printing operation need be stopped, thus reducing the printing speed.

In addition, it is conceivable to provide, with the carriage, a detector for detecting the remaining amount of ink in the sub tank, a driving device for driving the air release unit of the sub tank, and a member and/or device to control ink supply to the sub tank. However, such a configuration increases the size and weight of the carriage, thus resulting in an increased size of the entire apparatus.

BRIEF SUMMARY

In an aspect of this disclosure, there is provided an image forming apparatus including an apparatus body, a recording head, a sub tank, a carriage, a main tank, a liquid feed device, a displacement member, a first detector, a second detector, a detection retainer, a liquid consumption amount measuring device, and a supply controller. The recording head ejects liquid droplets. The sub tank stores liquid to be supplied to the recording head. The carriage mounts the recording head and the sub tank. The main tank stores the liquid to be supplied to the sub tank. The liquid feed device supplies the liquid from the main tank to the sub tank. The displacement member is provided at the sub tank and displaceable with a remaining amount of the liquid in the sub tank. The first detector is mounted on the carriage to detect a first position of the displacement member. The second detector is mounted on the apparatus body to detect a second position of the displacement member. The detection retainer detects and retains a differential supply amount corresponding to a first displacement amount of the displacement member between the first position and the second position or a second displacement amount obtained by subtracting a predetermined displacement amount from the first displacement amount. The liquid consumption amount measuring device measures a consumption amount of the liquid in the sub tank when the displacement member displaces from the first position in a direction in which the consumption amount of the liquid in the sub tank decreases. The supply controller, in supplying the liquid from the main tank to the sub tank without using the second detector, starts supply of the liquid when the consumption amount of the liquid measured by the liquid consumption amount measuring device reaches a predetermined threshold value, and supplies the liquid by the differential supply amount after the first detector detects the displacement member. When the first position of the displacement member is detected with the first detector, the remaining amount of the liquid in the sub tank is smaller than when the second position of the displacement member is detected with the second detector. When a detection output of the first detector continues to be, for a predetermined time or number of times, in a detection state in which the first detector detects the displacement member and shifts from the detection state to a non detection state in which the first detector does not detect the displacement member, the liquid consumption amount measuring device starts measuring the consumption amount of the liquid in the sub tank.

In another aspect of this disclosure, there is provided an image forming apparatus including an apparatus body, a recording head, a sub tank, a carriage, a main tank, a liquid feed device, a displacement member, a first detector, a second detector, a detection retainer, a liquid consumption amount measuring device, and a supply controller. The recording head ejects liquid droplets. The sub tank stores liquid to be supplied to the recording head. The carriage mounts the recording head and the sub tank. The main tank stores the liquid to be supplied to the sub tank. The liquid feed device supplies the liquid from the main tank to the sub tank. The displacement member is provided at the sub tank and displaceable with a remaining amount of the liquid in the sub tank. The first detector is mounted on the carriage to detect a first position of the displacement member. The second detector is mounted on the apparatus body to detect a second position of the displacement member. The detection retainer detects and retains a differential supply amount corresponding to a first displacement amount of the displacement member between the first position and the second position or a second displacement amount obtained by subtracting a predetermined displacement amount from the first displacement amount. The liquid consumption amount measuring device measures a consumption amount of the liquid in the sub tank when the displacement member displaces from the first position in a direction in which the consumption amount of the liquid in the sub tank decreases. The supply controller, in supplying the liquid from the main tank to the sub tank without using the second detector, starts supply of the liquid when the consumption amount of the liquid measured by the liquid consumption amount measuring device reaches a predetermined threshold value, and supplies the liquid by the differential supply amount after the first detector detects the displacement member. When the first position of the displacement member is detected with the first detector, the remaining amount of the liquid in the sub tank is smaller than when the second position of the displacement member is detected with the second detector. After a detection output of the first detector continues to be, for a first predetermined time or number of times, in a detection state in which the first detector detects the displacement member, shifts from the detection state to a non detection state in which the first detector does not detect the displacement member, and continues to be in the non detection state for a second predetermined time or number of times, the liquid consumption amount measuring device starts measuring the consumption amount of the liquid in the sub tank.

In still another aspect of this disclosure, there is provided an image forming apparatus including an apparatus body, a recording head, a head tank, a carriage, a main tank, a liquid feed device, a supply controller, a displacement member, a first detector, and a second detector. The recording head ejects liquid droplets. The head tank stores liquid to be supplied to the recording head. The carriage mounts the recording head and the head tank. The main tank stores the liquid to be supplied to the head tank. The liquid feed device supplies the liquid from the main tank to the head tank. The supply controller controls driving of the liquid feed device to supply the liquid from the main tank to the head tank. The displacement member is provided at the head tank and displaceable with a remaining amount of the liquid in the head tank. The first detector is mounted on the carriage to detect a first position of the displacement member. The second detector is mounted on the apparatus body to detect a second position of the displacement member. The supply controller detects and retains a differential supply amount corresponding to a displacement amount of the displacement member between the first position and the second position. When the first position of the displacement member is detected with the first detector, the remaining amount of the liquid in the head tank is smaller than when the second position of the displacement member is detected with the second detector. When the liquid is supplied from the main tank to the head tank without using the second detector during printing operation, the supply controller measures a consumption amount of the liquid in the head tank. When the consumption amount of the liquid reaches a predetermined threshold value at which a remaining amount of the liquid stored in the head tank is smaller than when the first detector detects the displacement member, the supply controller starts supplying the liquid from the main tank to the head tank. After the first detector detects the displacement member, the supply controller controls the liquid feed device to supply the liquid by the differential supply amount from the main tank to the head tank. When the differential supply amount is less than a predetermined value, the supply controller starts measuring the consumption amount of the liquid in the head tank at end of supplying the liquid by the differential supply amount. When the differential supply amount is not less than the predetermined value, the supply controller starts measuring the consumption amount of the liquid in the head tank after supplying of the liquid by the differential supply amount ends and a detection output of the first detector shifts from a detection state in which the first detector detects the displacement member to a non detection state in which the first detector does not detect the displacement member.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
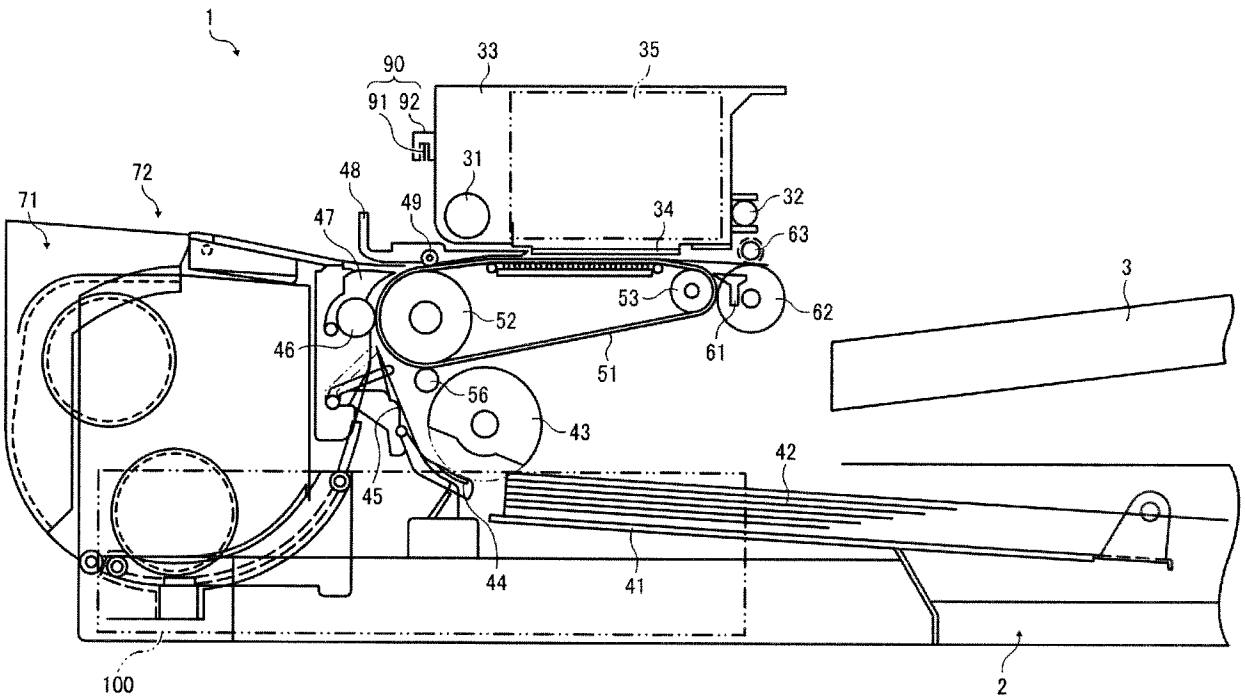
FIG. 1 is a schematic side view of a mechanical section of an image forming apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF THE INVENTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results. For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid useable as targets of image formation. For example, the term "ink" includes recording liquid, fixing solution, DNA sample, resist, pattern material, resin, and so on. The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a plan view of the image forming apparatus.

In this exemplary embodiment, the image forming apparatus is described as a serial-type inkjet recording apparatus. It is to be noted that the image forming apparatus is not limited to such a serial-type inkjet recording apparatus and may be any other type image forming apparatus. In the image forming apparatus, a carriage 33 is supported by a main guide rod 31 and a sub guide rod 32 so as to be slidable in a direction (main scanning direction) indicated by an arrow MSD in FIG. 2. The main guide rod 31 and the sub guide rod 32 serving as guide members extend between a left side plate 21A and a right side plate 21B standing of an apparatus body 1. The carriage 33 is reciprocally moved for scanning in the main scanning direction MSD by a main scanning motor via a timing belt.

The carriage 33 mounts recording heads 34*a* and 34*b* (collectively referred to as "recording heads 34" unless distinguished) formed with liquid ejection heads for ejecting ink droplets of different colors, e.g., yellow (Y), cyan (C), magenta (M), and black (K). The recording heads 34*a* and 34*b* are mounted on the carriage 33 so that nozzle rows, each of which includes multiple nozzles, are arranged in parallel to a direction (sub scanning direction) perpendicular to the main scanning direction and ink droplets are ejected downward from the nozzles.

Each of the recording heads 34 has two nozzle rows. For example, one of the nozzles rows of the recording head 34*a* ejects liquid droplets of black (K) and the other ejects liquid droplets of cyan (C). In addition, one of the nozzles rows of the recording head 34*b* ejects liquid droplets of magenta (M) and the other ejects liquid droplets of yellow (Y).

The carriage 33 mounts sub tanks 35*a* and 35*b* (collectively referred to as "sub tanks 35" unless distinguished) to supply the respective color inks to the corresponding nozzle rows. A supply pump unit 24 supplies (replenishes) the respective color inks from ink cartridges 10*y*, 10*m*, 10*c*, and 10*k* removably mountable in a cartridge mount portion 4 to the sub tanks 35 via supply tubes 36 dedicated for the respective color inks.

An encoder scale 91 is disposed so as to extend along the main scanning direction MSD of the carriage 33. The carriage 33 mounts an encoder sensor 92 to read the encoder scale 91. The encoder scale 91 and the encoder sensor 92 form a linear encoder 90. The main scanning position (carriage position) and movement amount of the carriage 33 are detected by detection signals of the linear encoder 90.

The image forming apparatus further includes a sheet feed section to feed sheets 42 stacked on a sheet stack portion (platen) 41 of a sheet feed tray 2. The sheet feed section further includes a sheet feed roller 43 and a separation pad 44. The sheet feed roller 43 has a substantially half moon shape to separate the sheets 42 from the sheet stack portion 41 and feed the sheets 42 sheet by sheet. The separation pad 44 made of a material of a high friction coefficient is disposed opposing the sheet feed roller 43 and urged toward the sheet feed roller 43.

To feed the sheets 42 from the sheet feed section to a position below the recording heads 34, the image forming apparatus includes a first guide member 45 to guide the sheet 42, a counter roller 46, a conveyance guide member 47, a pressing member 48 including a front-end pressing roller 49, and a conveyance belt 51 to attract the sheet 42 thereon by static electricity and convey the sheet 42 to a position opposing the recording heads 34.

Figure 2:
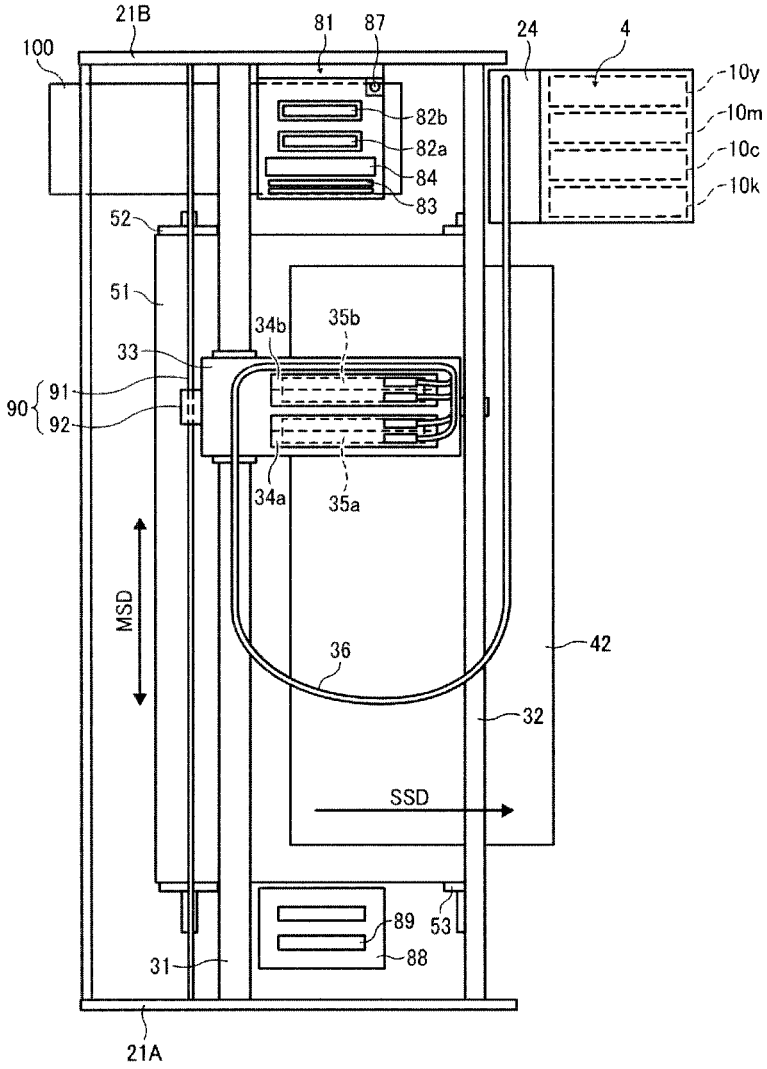
FIG. 2 is a partial plan view of the mechanical section of FIG. 1.

The conveyance belt 51 is an endless belt that is looped between a conveyance roller 52 and a tension roller 53 so as to circulate in a belt conveyance direction (sub-scanning direction indicated by an arrow SSD in FIG. 2). The image forming apparatus also has a charging roller 56 serving as a charger to charge the surface of the conveyance belt 51. The charging roller 56 is disposed so as to contact an outer surface of the conveyance belt 51 and rotate with the circulation of the conveyance belt 51. The conveyance roller 52 is rotated by a sub scanning motor via a timing belt, so that the conveyance belt 51 circulates in the belt conveyance direction.

The image forming apparatus further includes a sheet output section that outputs the sheet 42 on which an image has been formed by the recording heads 34. The sheet output section includes a separation claw 61 to separate the sheet 42 from the conveyance belt 51, a first output roller 62, a spur 63 serving as a second output roller, and a sheet output tray 3 disposed at a position lower than the first output roller 62.

A duplex unit 71 is detachably mounted on a rear face portion of the apparatus body 1. When the conveyance belt 51 rotates in reverse to return the sheet 42, the duplex unit 71 receives the sheet 42. Then the duplex unit 71 reverses and feeds the sheet 42 to a nipping portion between the counter roller 46 and the conveyance belt 51. A manual-feed tray 72 is formed at an upper face of the duplex unit 71.

As illustrated in FIG. 2, a maintenance device (maintenance and recovery device) 81 is disposed in a non-printing area (non-recording area) at one end in the main scanning direction of the carriage 33. The maintenance device 81 maintains and recovers nozzle conditions of the recording heads 34. The maintenance device 81 includes caps 82*a* and 82*b* (hereinafter collectively referred to as "caps 82" unless distinguished) to cap the nozzle faces of the recording heads 34, a wiping member (wiper blade) 83 to wipe the nozzle faces of the recording heads 34, a first dummy-ejection receptacle 84 to receive liquid droplets ejected by dummy ejection in which liquid droplets not contributing to image recording are ejected to remove increased-viscosity recording liquid, and a carriage lock 87 to lock the carriage 33. Below the maintenance device 81, a waste liquid tank 100 is removably mounted to the apparatus body 1 to store waste ink or liquid discharged by the maintenance and recovery operation.

As illustrated in FIG. 2, a second dummy ejection receptacle 88 is disposed at a non-printing area on the opposite end in the main scanning direction of the carriage 33. The second dummy ejection receptacle 88 receives liquid droplets ejected, e.g., during recording (image forming) operation by dummy ejection in which liquid droplets not contributing to image recording are ejected to remove increased-viscosity recording liquid. The second dummy ejection receptacle 88 has openings 89 arranged in parallel to the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed while being sandwiched between the conveyance belt 51 and the counter roller 46. Further, the front end of the sheet 42 is guided by the conveyance guide member 47 and pressed against the conveyance belt 51 by the front-end pressing roller 49 to turn the transport direction of the sheet 42 by approximately 90°.

At this time, positive and negative voltages are alternately supplied to the charging roller 56 so that plus outputs and minus outputs to the charging roller 56 are alternately repeated. As a result, the conveyance belt 51 is charged in an alternating voltage pattern, that is, so that positively-charged areas and negatively-charged areas are alternately repeated at a certain width in the sub-scanning direction SSD, i.e., the belt conveyance direction. When the sheet 42 is fed onto the conveyance belt 51 alternately charged with positive and negative charges, the sheet 42 is attracted on the conveyance belt 51 and conveyed in the sub scanning direction by the circulation of the conveyance belt 51.

By driving the recording heads 34 in accordance with image signals while moving the carriage 33, ink droplets are ejected onto the sheet 42, which is stopped below the recording heads 34, to form one line of a desired image. Then, the sheet 42 is fed by a certain distance to prepare for the next operation to record another line of the image. Receiving a recording end signal or a signal indicating that the rear end of the sheet 42 has arrived at the recording area, the recording operation finishes and the sheet 42 is output to the sheet output tray 3.

To perform maintenance and recovery operation on the nozzles of the recording heads 34, the carriage 33 is moved to a home position at which the carriage 33 opposes the maintenance device 81. Then, the maintenance-and-recovery operation, such as nozzle sucking operation for sucking ink from nozzles with the nozzle faces of the recording heads 34 capped with the caps 82 and/or dummy ejection for ejecting liquid droplets not contributed to image formation, is performed, thus allowing image formation with stable droplet ejection.

Next, an example of the sub tank 35 is described with reference to FIGS. 3 and 4.

Figure 3:
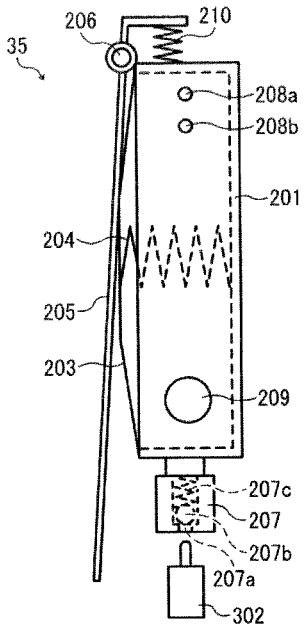
FIG. 3 is a schematic plan view of an example of a sub tank of the image forming apparatus.
Figure 4:
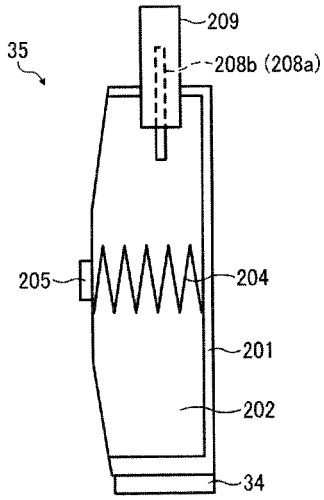
FIG. 4 is a schematic front cross sectional view of the sub tank illustrated in FIG. 3.

FIG. 3 is a schematic plan view of the sub tank 35 corresponding to one nozzle row. FIG. 4 is a schematic front view of the sub tank 35 of FIG. 3.

The sub tank 35 has a tank case 201 forming an ink accommodation part to accommodate ink and having an opening at one side. The opening of the tank case 201 is sealed with a flexible film 203 serving as a flexible member, and a spring 204 serving as an elastic member is disposed in the tank case 201 to constantly urge the flexible film 203 outward. Thus, the outward urging force of the spring 204 acts on the flexible film 203 of the tank case 201. As a result, the remaining amount of ink in the ink accommodation part 202 of the tank case 201 decreases, thus creating negative pressure.

At the exterior of the tank case 201, a displacement member (hereinafter, may also be referred to as simply "feeler") 205 formed with a feeler having one end pivotably supported by a support shaft 206 is fixed on the flexible film 203 by, e.g., adhesive. The displacement member 205 is urged toward the tank case 201 by a spring 210 and displaces with movement of the flexible film 203. By detecting the displacement member 205 with, e.g., a second detector (second sensor) 301 mounted on the carriage 33 or a first detector (first sensor or ink-full detection sensor) 251 disposed at the apparatus body 1, the remaining amount of ink or negative pressure in the sub tank 35 can be detected.

A supply port portion 209 is disposed at an upper portion of the tank case 201 and connected to the supply tube 36 to supply ink from the ink cartridge 10. At one side of the tank case 201, an air release unit 207 is disposed to release the interior of the sub tank 35 to the atmosphere. The air release unit 207 includes an air release passage 207*a* communicating with the interior of the sub tank 35, a valve body 207*h* to open and close the air release passage 207*a*, and a spring 207*c* to urge the valve body 2076 into a closed state. An air release solenoid 302 is disposed at the apparatus body 1, and the valve body 207*b* is pushed by the air release solenoid 302 to open the air release passage 207*a*, thus causing the interior of the sub tank 35 to be opened to the atmosphere (in other words, causing the interior of the sub tank 35 to communicate with the atmosphere).

Electrode pins 208*a* and 208*b* are mounted in the sub tank 35 to detect the height of the liquid level of ink in the sub tank 35. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink has decreased to a threshold level or lower, i.e., the amount of air in the sub tank 35 has increased to a threshold amount or more.

Figure 5:
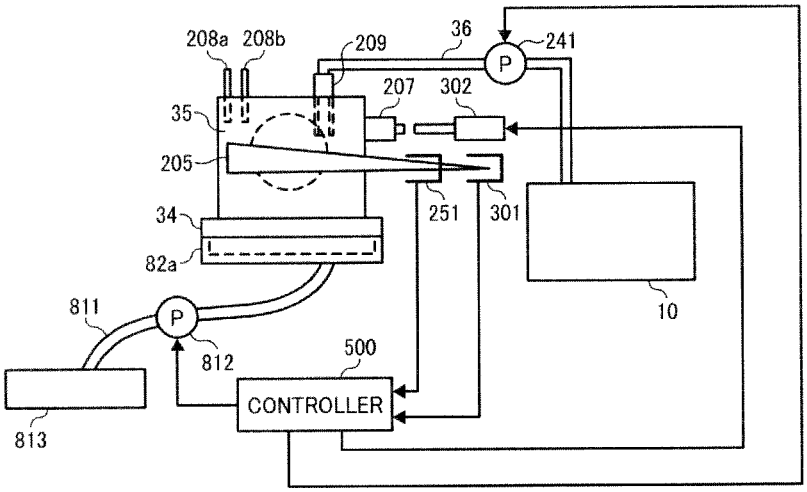
FIG. 5 is a schematic view of an ink supply-and-discharge system of the image forming apparatus.

Next, an ink supply-and-discharge system of the image forming apparatus is described with reference to FIG. 5.

A liquid feed pump 241 serving as a liquid feed device of the supply pump unit 24 supplies ink from the ink cartridge 10 (hereinafter, main tank 10) to the sub tank 35 via the supply tube 36. The liquid feed pump 241 is a bidirectional pump, e.g., a tube pump, capable of supplying ink from the ink cartridge 10 to the sub tank 35 and returning ink from the sub tank 35 to the ink cartridge 10.

The maintenance device 81, as described above, has the cap 82*a* to cover the nozzle face of the recording head 34 and a suction pump 812 connected to the cap 82*a*. The suction pump 812 is driven with the nozzle face capped with the cap 82*a* to suck ink from the nozzles via a suction tube 811, thus allowing ink to be sucked from the sub tank 35. Waste ink sucked from the sub tank 35 is discharged to a waste liquid tank 100.

The air release solenoid 302 serving as a pressing member to open and close the air release unit 207 of the sub tank 35 is disposed at the apparatus body 1. By activating the air release solenoid 302, the air release unit 207 can be opened.

At the carriage 33 is mounted the first sensor 251 that is an optical sensor serving as the first detector to detect the displacement member 205. At the apparatus body 1 is disposed the second sensor 301 that is an optical sensor serving as the second detector to detect the displacement member 205. As described below, ink supply operation for supplying ink to the sub tank 35 is controlled based on detection results of the first sensor 251 and the second sensor 301.

The driving control of the liquid feed pump 241, the air release solenoid 302, and the suction pump 812 and the ink supply control according to exemplary embodiments of this disclosure are performed by the controller 500.

Next, an example of the arrangement of the first and second sensors is described with reference to FIG. 6.

Figure 6:
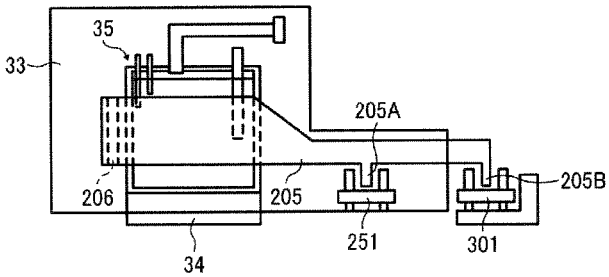
FIG. 6 is a schematic view of an example of arrangement of first and second sensors.

In the example illustrated in FIG. 6, detected portions 205A and 205B having different lengths (distances) from the support shaft 206 (pivot axis) are disposed at a lower side of the displacement member 205 of the sub tank 35. The first sensor 251 of the carriage 33 detects the detected portion 205A, and the second sensor 301 disposed at the apparatus body detects the detected portion 205B.

Next, an outline of the controller of the image forming apparatus is described with reference to FIG. 7.

Figure 7:
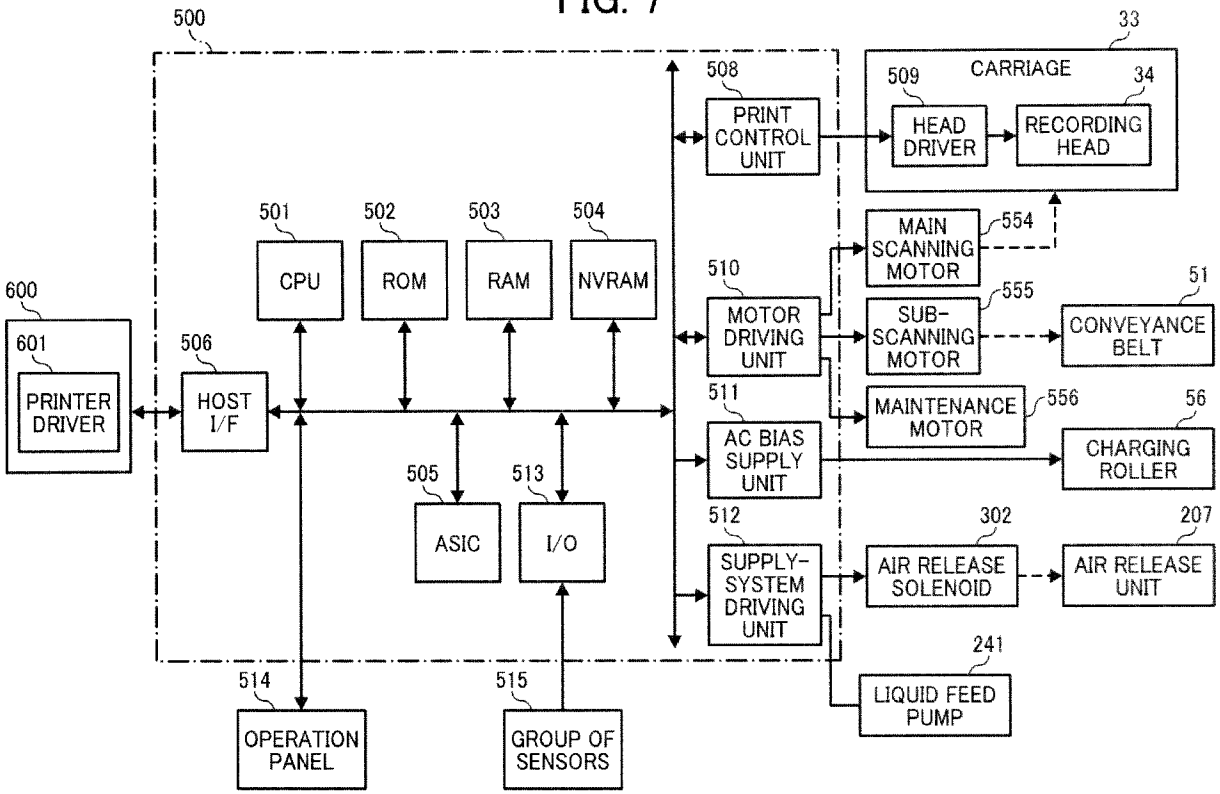
FIG. 7 is a schematic block diagram of a controller of the image forming apparatus.

FIG. 7 is a block diagram of the controller 500 of the image forming apparatus. The controller 500 includes a central processing unit (CPU) 501 a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and serves as various control units including a supply control unit according to exemplary embodiments of this disclosure. The ROM 502 stores programs executed by the CPU 501 and other fixed data, and the RAM 503 temporarily stores image data and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a motor driving unit 510, an alternating current (AC) bias supply unit 511, and a supply-system driving unit 512. The print control unit 508 includes a data transmitter and a driving signal generator to drive and control the recording heads 34 according to print data. The head driver 509 drives the recording heads 34 mounted on the carriage 33. The motor driving unit 510 drives the main scanning motor 554 to move the carriage 33 for scanning, drives the sub-scanning motor 555 to circulate the conveyance belt 51, and drives the maintenance motor 556 of the maintenance device 81. The AC bias supply unit 511 supplies AC bias to the charging roller 56. The supply-system driving unit 512 drives the liquid feed pump 241 and the air release solenoid 302 disposed at the apparatus body 1 to open and close the air release unit 207 of the sub tank 35.

The controller 500 is connected to an operation panel 514 for inputting and displaying information necessary to the image forming apparatus.

The controller 500 includes a host interface (I/F) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the I/F 506, performs desired image processing, data sorting, or other processing with the ASIC 505, and transfers image data to the head driver 509. Dot-pattern data for image output may be created by a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. At this time, by selecting a part or all of the driving pulses forming the driving signals, the recording heads 34 can selectively eject different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the motor driving unit 510, the AC bias supply unit 511, and ink supply to the sub tanks 35 based on the extracted information.

Besides the first sensor 251, the second sensor 301, and the detection electrode pins 208*a* and 208*b*, the group of sensors 515 includes, for example, an optical sensor to detect the position of the sheet of recording media, a thermistor (environment temperature and/or humidity sensor) to monitor temperature and/or humidity in the apparatus, a voltage sensor to monitor the voltage of the charged belt, and an interlock switch to detect the opening and closing of a cover. The I/O unit 513 is capable of processing various types of information transmitted from the group of sensors.

Next, negative-pressure forming operation of the sub tank 35 is described with reference to FIGS. 8A and 8B.

Figure 8A:
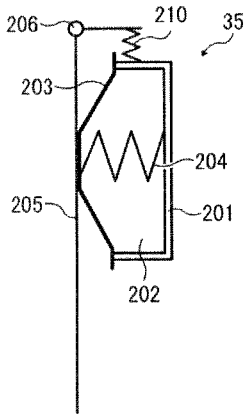
FIG. 8A is a schematic view of the sub tank in a state during negative-pressure forming operation.
Figure 8B:
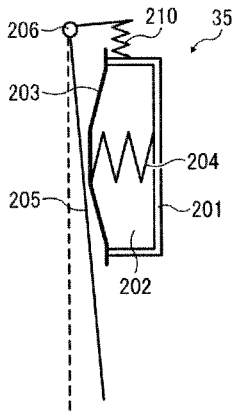
FIG. 8B is a schematic view of the sub tank in another state during negative-pressure forming operation.

As illustrated in FIG. 8A, after ink is supplied from the main tank 10 to the sub tank 35, ink is sucked from the sub tank 35 or the recording head 34 is driven to eject droplets (perform dummy ejection, i.e., eject liquid droplets not contributing to image formation), thus reducing the amount of ink in the sub tank 35. As a result, as illustrated in FIG. 8B, the flexible film 203 deforms inward against the urging force of the spring 204. Thus, the urging force of the spring 204 creates a negative pressure in the sub tank 35.

In addition, when the sub tank 35 is sucked by the liquid feed pump 241, the flexible film 203 is drawn inward. As a result, the spring 204 is further compressed, thus increasing the negative pressure.

Then, before the negative pressure becomes excessively high, by supplying ink to the sub tank 35, the flexible film 203 is pushed outward of the sub tank 35. As a result, the spring 204 is expanded, thus reducing the negative pressure.

By repeating such operation, the negative pressure in the sub tank 35 can be controlled within a certain range.

Figure 9:
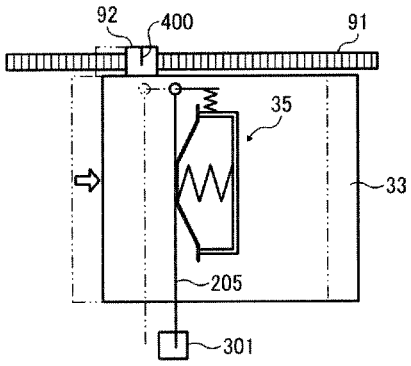
FIG. 9 is a schematic view of the sub tank in a state during negative-pressure control.

For the negative pressure control of the negative pressure in the sub tank 35, for example, as illustrated in FIG. 9, the amount of ink (negative pressure) is controlled based on a scanning position 400 of the carriage 33 obtained when the displacement member 205 is detected by the second sensor 301 during movement of the carnage 33.

FIG. 9 shows a state in which the displacement member 205 is detected by the second sensor 301 when the carriage 33 moves from a position indicated by a broken line to a position indicated by a solid line.

Figure 10:
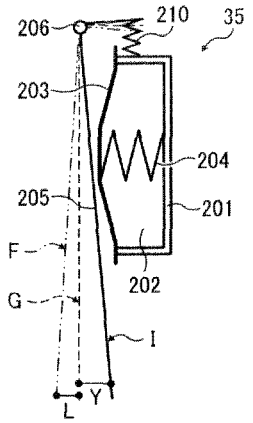
FIG. 10 is a schematic view of a displacement member of the sub tank at different positions.

Next, positions of the displacement member of the sub tank are described with reference to FIG. 10.

In a proper range Y of negative pressures in the sub tank 35, the displacement member 205 takes the ink full position G (upper threshold value of the amount of ink) at a lowest negative pressure in the range and a supply start position (lower threshold value) I at a highest negative pressure in the range. An air release position F is a position at which the displacement member 205 is more opened relative to the tank case 201 than the ink full position G.

Here, ink is once supplied to the sub tank 35 with the interior of the sub tank 35 opened to the atmosphere. Then, by closing the interior of the sub tank 35 from the atmosphere, a position of the displacement member 205 in the atmospheric state can be detected. From that position, the carriage 33 is moved at a distance corresponding to a designated count L. When ink is drawn back (returned to the main tank 10) till the displacement member 205 is detected, the displacement member 205 takes the ink full position G.

Such a configuration is not affected by accumulation of variations among components. In addition, even in a case in which the extension and contraction of the flexible film 203 are affected by temperature and humidity, such a configuration can reset the ink full position, thus allowing a constant negative pressure to be set as the ink full position.

Next, detecting operation of differential supply amount is described with reference to FIG. 11.

As described above, the image forming apparatus includes the displacement member 205 that displaces with the remaining amount of ink in the sub tank 35, the first sensor 251 formed with, e.g., a transmissive photosensor fixed on the carriage 33 to detect the displacement member 205, and the second sensor 301 fixed at the apparatus body.

Figure 11:
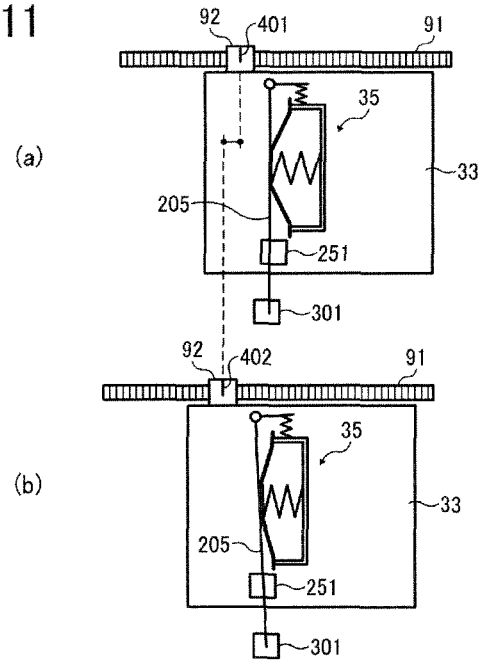
FIG. 11 is a schematic view of a carriage mounting the sub tank placed at different positions (a) and (b) during detection of a differential supply amount.

As illustrated in (a) and (b) of FIG. 11, a difference is detected between a (carriage) position 401 of the carriage 33 (obtained by the linear encoder 90) at the ink full position detected by the second sensor 301 and a (carriage) position 402 of the carriage 33 (obtained by the linear encoder 90) at a position at which the displacement member 205 is detected by the first sensor 251, and stored and retained as a differential supply amount.

That is, a position at which the displacement member 205 is detected by the second sensor 301 of the apparatus body 1 is referred to as second position, and the second position is defined as the ink full position. In addition, a position at which the displacement member 205 is detected by the first sensor 251 of the carriage 33 is referred to as first position, and the remaining amount of ink (liquid) in the sub tank 33 is smaller at the first position than the second position.

As described above, in this exemplary embodiment, the first detector (first sensor) 251 is disposed at the carriage 33 to detect that the displacement member 205 is placed at the first position. The second detector (second sensor) 301 is disposed at the apparatus body 1 to detect that, when ink is replenished from the main tank 10 to the sub tank 35 with the carriage 33 stopped at a certain detection position, the displacement member 205 is placed at the second position (ink full position). The first position is set to be a position at which the remaining amount of ink in the sub tank 35 is smaller than at the second position.

As described above, by obtaining and storing the differential supply amount (displacement amount c), the following operation can be performed. That is, when it is detected that a certain threshold amount of ink is ejected during scanning of the carriage 33 (the liquid consumption amount becomes a threshold value or more), ink can be supplied and replenished from the main tank 10 to the sub tank 35. After the first sensor 251 detects the displacement member 205 of the sub tank 35, ink is further supplied to the sub tank 35 by the differential supply amount, thus allowing ink to be supplied up to the ink full position in the sub tank 35.

In such a case, since the detection of the first sensor 251 is position detection, accumulated detection errors in, e.g., the amount of ink ejected and the liquid feed amount of the liquid feed pump 241 are canceled on detection of the first sensor 251. Thus, even during scanning of the carriage 33, ink ejection and ink supply can be repeatedly performed without accumulating detection errors.

By repeating the above-described series of operations, ink can be supplied to the sub tank 35 up to the ink full position without interrupting printing operation, thus enhancing the printing speed or efficiency.

Figure 12:
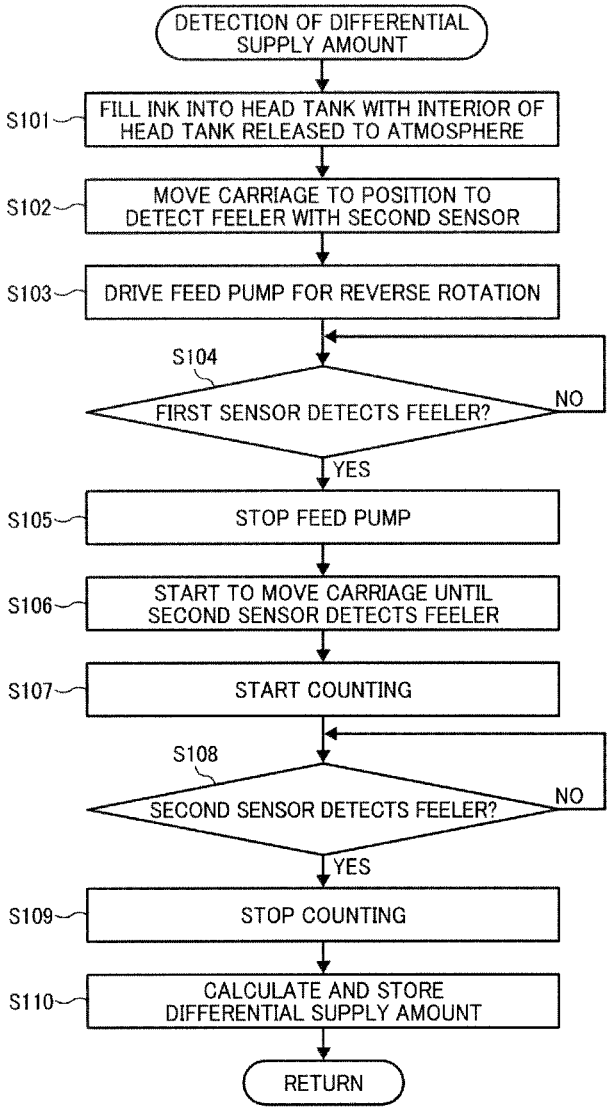
FIG. 12 is a flowchart of a procedure of calculation (detection) of a differential supply amount performed by the controller in the first exemplary embodiment.

Next, a procedure of calculation (detection) of the differential supply amount performed by the controller in the first exemplary embodiment of the present disclosure is described with reference to FIG. 12.

At S101, with the internal air of the sub tank 35 released to the atmosphere, ink is filled to the sub tank 35 (air release filling). In that state, at S102 the carriage 33 moves to the position (second position) to detect the displacement member 205 (referred to as "feeler" in FIG. 12) with the second sensor 301. As a result, the displacement member 205 of the sub tank 35 is placed at the air release position.

From the state in which the displacement member 205 is placed at the air release position, at S103 the liquid feed pump 241 is driven to rotate in reverse to suck ink until the first sensor 251 detects the displacement member 205. When the first sensor 251 detects the displacement member 205 (YES at S104), at S105 the liquid feed pump 241 stops the reverse rotation.

At 106, the carriage 33 starts moving to the position at which the second sensor 301 detects the displacement member 205. At S107, the linear encoder 90 starts counting. When the second sensor 301 detects the displacement member 205 (YES at S108), at S109 the linear encoder 90 stops counting.

As a result, the displacement amount (difference) of the displacement member 205 is detected between the air release position (second position of the carriage 33) and the first position at which when the first sensor 251 detects the displacement member 205. Thus, at S110, a differential displacement amount is obtained by subtracting a predetermined displacement amount from the difference, and a liquid amount corresponding to the differential displacement amount is stored and retained as a differential supply amount.

The differential displacement amount itself may be stored and retained. In such a case, when ink supply operation is performed, ink is supplied to the sub tank by the differential supply amount, i.e., a liquid amount corresponding to differential displacement amount. Alternatively, a driving time (differential supply time t) of the liquid feed pump 241 corresponding to the differential supply amount may be stored. In such a case, when ink supply operation is performed, the liquid feed pump 241 is driven for the differential supply time t corresponding to the differential supply amount.

As described above, in this exemplary embodiment, the air release position of displacement member 205 corresponds to the second position of the carriage 33. Alternatively, the ink full position may correspond to the second position, and a supply amount corresponding to a displacement amount between the second position and the first position may be stored as the differential supply amount. It depends on how to determine the ink full position.

Figure 13:
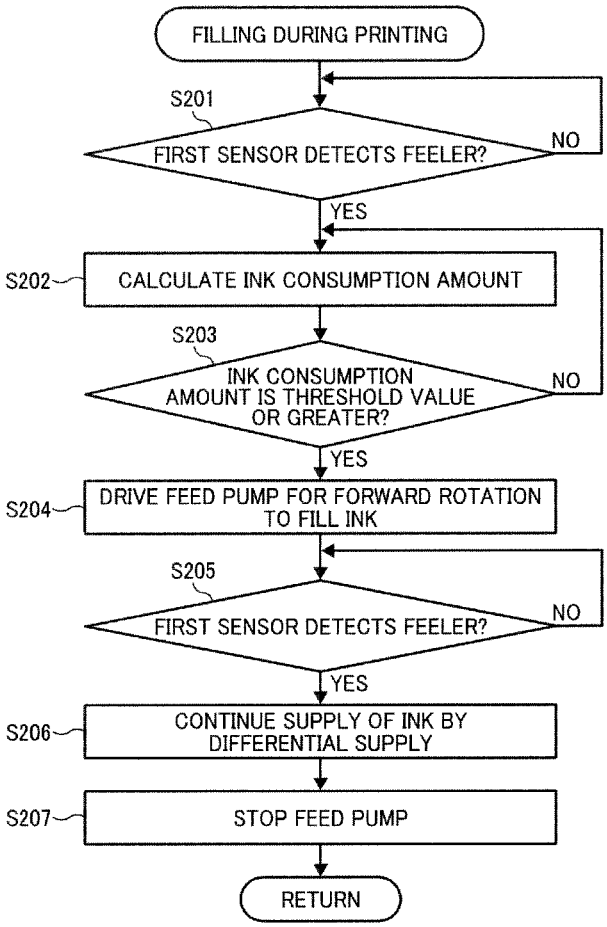
FIG. 13 is a flowchart of a procedure of ink filling during printing.

Next, ink filling performed by the controller during printing is described with reference to FIG. 13.

During printing operation, as ink of the sub tank 35 is consumed from the ink full state, the displacement member 205 shifts in a direction in which the remaining amount of ink (liquid remaining amount) in the sub tank 35 decreases. At S201, the controller determines whether or not the first sensor 251 detects the displacement member 205.

When the first sensor 251 detects the displacement member 205 (YES at S201), at S202 the controller calculates the consumption amount of ink and at S203 determines whether or not the consumption amount of ink is a predetermined liquid consumption amount (threshold amount) or greater.

For example, the number of droplets ejected for image formation and dummy ejection during printing operation is counted, and by multiplying the counted number with the liquid amount of each droplet, the consumption amount of ink can be calculated. This process is referred to as soft counting, and the controller uses the soft counting as measuring means of the liquid consumption amount. In addition, when the cleaning operation is performed to suck ink from the recording head 34, the consumption (suction) amount of ink consumed by the sucking operation is predetermined. Thus, the consumption (suction) amount of ink is added to the ink consumption amount.

When the ink consumption amount becomes a predetermined liquid consumption amount (threshold value) C or greater (YES at S203), the controller determines that the displacement member 205 has arrived at the supply start position, and at S204 drives the liquid feed pump 241 to rotate forward and starts to fill (supply) ink to the sub tank 35.

At S205, the controller determines whether or not the first sensor 251 detects the displacement member 205 of the sub tank 35. When the first sensor 251 detects the displacement member 205 of the sub tank 35 (YES at S205), at S206 the controller continues the forward rotation of the liquid feed pump 241 to further till ink to the sub tank 35 by the differential supply amount (differential supply amount B or differential supply lime t) from the detection of the displacement member 205 with the first sensor 251.

At S207, the controller stops the liquid feed pump 241 and resets the calculation value of the ink consumption amount.

Thus, even during printing operation, ink can be filled to the sub tank 35 without returning the carriage 33 to the home position.

Figure 14:
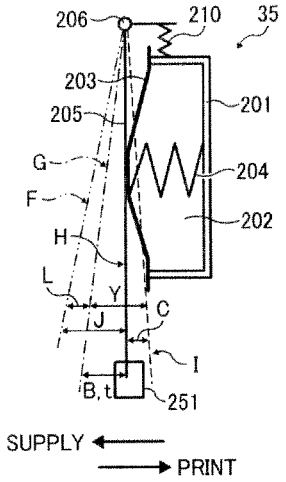
FIG. 14 is a schematic view of the sub tank in the detection of the differential supply amount and ink filling during printing.

In this regard, further description is given with reference to FIG. 14.

In this exemplary embodiment, the second position with the second sensor 301 corresponds to the air release position F, and the position detected with the first sensor 251 corresponds to a first position H.

The differential supply amount B is determined with reference to the air release position F. In other words, as illustrated in FIG. 14, the displacement amount of the displacement member 205 between the air release position F and the first position H is defined as a displacement distance J. A distance obtained by subtracting a predetermined distance k from the displacement distance J is defined as a differential displacement amount b. An ink amount corresponding to the differential displacement amount b is defined as the differential supply amount B.

The displacement distance J between the air release position F and the first position H can be obtained as a carriage movement distance. For example, with the interior of the sub tank 35 released to the atmosphere, the displacement member 205 is detected with the second sensor 301. Then, ink is filled to the sub tank 35 and sucked in reverse until the first sensor 251 detects the displacement member 205. Furthermore, the carriage 33 is moved until the second sensor 301 detects the displacement member 205, thus detecting the displacement distance J as the carriage movement distance.

The predetermined distance k is obtained by adding a distance m derived from variations to a distance L from the air release position F to the ink full position G. The variations include, for example, fluctuations of the displacement member 205 caused by the scanning of the carriage 33, variations in distance detected by the first sensor 251 and the second sensor 301, variations in detected time, and a time lag in stopping the liquid feed pump 241.

The differential displacement amount b can be converted to a liquid amount (ink amount) from a displacement characteristic (R=liquid amount/displacement amount [cc/mm]) of the displacement member 205 of the sub tank 35.

As described above, the sub tank has the displacement member displaceable with the remaining amount of liquid, the first detector is disposed at the carriage to detect the displacement member, and the second detector is disposed at the apparatus body to detect the displacement member. At the first position of the displacement member detected with the first detector, the remaining amount of liquid in the sub tank is smaller than at the second position of the displacement member detected with the second detector. The supply controller detects a displacement amount of the displacement member between the first position and the second position and retains a differential supply amount corresponding to a differential displacement amount obtained by subtracting a predetermined displacement amount from the displacement amount. During image forming operation, when the displacement member shifts in a direction in which the remaining amount of ink in the sub tank decreases and the amount of liquid consumed in the sub tank after detection of the displacement member with the first detector arrives at a predetermined liquid consumption amount (threshold value), the controller starts to supply liquid from the main tank to the sub tank. After the first detector detects the displacement member, the controller performs control to supply liquid to the sub tank by the differential supply amount corresponding to the differential displacement amount. Such a configuration allows a proper amount of liquid to be supplied from the math tank to the sub tank during image formation, in particular, even during movement of the carriage, thus increasing the printing speed.

Here, a description is given of a reason that the second sensor 301 is also provided at the apparatus body instead of detecting the displacement member 25 with only the first sensor 251 of the carriage 33.

First, the ink full position of the sub tank 35 varies depending on the ambient environment, and the variation cannot be determined by only the first sensor 251 of the carriage 33 because the first sensor 251 can detect only one position at a time. Hence, in this exemplary embodiment, the second sensor 301 is provided at the apparatus body. Moving the carriage 33 allows detection of the air release position and the ink-full detection position that vary depending on the environment.

In other words, the distance between two points, i.e., a fixed detection point on the carriage 33 and a detection point movable with movement of the carriage 33 can be detected based on the driving time or number of rotations of the liquid feed pump or the counting of the encoder with movement of the carriage, thus allowing the ink supply amount to be controlled in response to the environmental variation.

Alternatively, a sensor or encoder capable of detecting any displacement only from the carriage 33 be provided at the carriage 33. However, such a configuration increases the cost of the detector and the sizes of the carriage and the apparatus.

In addition, the liquid feed amount (supply or suction amount) of the liquid feed pump may fluctuate due to the environmental variation, deteriorations with time, and/or variation of components. In other words, since the amount of ink supplied by the liquid feed pump until the second sensor 301 of the apparatus body detects the displacement member may fluctuate depending on the environment, the amount of ink supplied by the liquid feed pump is preferably confirmed by the positional detection of the second sensor 301. If the ink supply amount of the liquid feed pump is controlled based on only the driving amount of the liquid feed pump without the second sensor 301 of the apparatus body, excessive or insufficient supply might occur and cause a failure. Hence, in this exemplary embodiment, the second sensor 301 is provided to assure the safety of supply control.

Next, a description is given of a possible problem in the detection of the displacement member 205 with the first sensor 251 used as a reference point to start measuring the consumption amount of ink in ink filling operation performed during printing.

Figure 15:
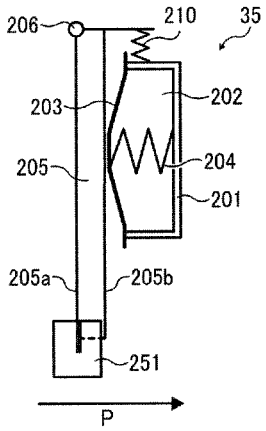
FIG. 15 is a schematic view of a displacement member and a detection position of the displacement member detected with a first sensor in a comparative example.

In this comparative example, as illustrated in FIG. 15, the displacement member 205 has a certain thickness in the displacement direction. Measurement (soft counting) of the consumption amount of ink is started with reference to an outer edge 205*a* of the displacement member 205, and an inner edge 205*b* is not used in the measurement of the consumption amount of ink.

When the first sensor 251 detects the displacement member 205, the detection output of the first sensor 251 turns into ON state (also referred to as "1"). By contrast, when the first sensor 251 does not detect the displacement member 205, the detection output of the first sensor 251 turns into OFF state (also referred to as "0").

During printing, as the remaining amount of liquid in the sub tank 35 decreases, the displacement member 205 displaces in a direction indicated by an arrow P in FIG. 15. As a result, when the first sensor 251 detects the outer edge 205*a* of the displacement member 205, i.e., the detection output of the first sensor 251 shifts from ON state to OFF state, the soft counting of the consumption amount of ink starts.

However, since the sub tank 35 is mounted on the carriage 33, the displacement member 205 of the sub tank 35 may fluctuate (reciprocally displaces in the main scanning direction) with movement of the carriage 33 during printing.

As a result, if after the displacement member 205 shifts to the position detected by the first sensor 251, the displacement member 205 shifts in a direction opposite the direction P of FIG. 15 due to the fluctuations, the detection output of the first sensor 251 shifts from ON state to OFF state (the inner edge 205*b* side), thus causing the controller monitoring the detection output of the first sensor 251 to determine that the first sensor 251 has detected the outer edge 205*a*.

Figure 16:
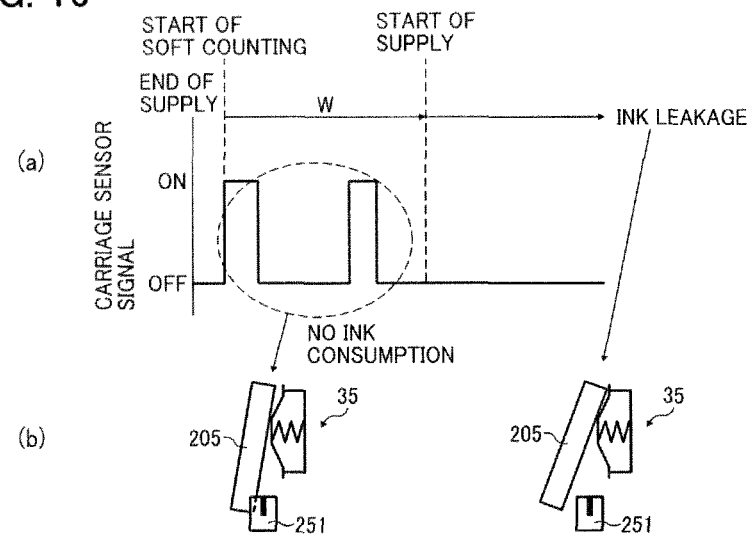
FIG. 16 shows, in the comparative example of FIG. 15, (a) a detection output (carriage sensor signal) of a first sensor detecting a displacement member and (b) a relationship between the first sensor and positions of the displacement member.

In particular, when ink is not ejected from faulty nozzles, ink of the sub tank is not consumed even if the number of ejected droplets accumulates in the soft counting. As a result, for example, as illustrated in FIG. 16, when the count value (ink consumption amount) of the soft counting from the start of counting the liquid consumption amount reaches a threshold value W (predetermined consumption amount C), the displacement member 205 may be in OFF state near the inner edge 205*b*. In such a case, even when the controller starts to supply ink to the sub tank 35 assuming that the ink consumption amount is the threshold value W or greater, the detection output of the first sensor 251 does not turn into ON state, thus causing oversupply of ink to the sub tank and ink leakage from the recording head.

In this regard, the detection of the displacement member with the first sensor and the start timing of measuring the consumption amount of ink in this exemplary embodiment are described with reference to FIG. 17.

Figure 17:
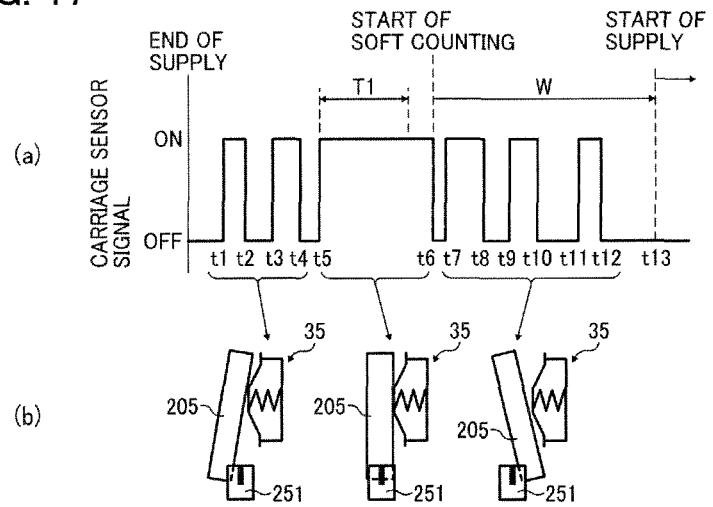
FIG. 17 shows, in the first exemplary embodiment of this disclosure, (a) a detection output of the first sensor detecting the displacement member and a start timing of measurement of the consumption amount of ink and (b) a relationship between the first sensor and positions of the displacement member.

FIG. 17 shows (a) a detection output of the first sensor (referred to as carriage sensor signal) and (b) a relation between the first sensor and positions of the displacement member, which are the same as in the following drawings.

In this first exemplary embodiment, as illustrated in FIG. 17, when, after the end of the ink supply of the sub tank 35, the time during which the detection output of the first sensor 251 is in ON state exceeds a predetermined time T1 and the detection output of the first sensor 251 shifts to OFF state, the controller determines that the first sensor 251 has detected the outer edge 205*a* of the displacement member 205 and starts the soft counting (measurement) of the ink consumption amount.

In other words, in the example of FIG. 17, after the end of ink supply, the detection output shifts from OFF state to ON state at time points t1 and t3. However, as the ON state does not continue for the predetermined time T1, the soft counting does not start at time points t2 and t4.

At a time point t5, the detection output shifts to ON state, and the ON state continues over the predetermined time T1 and to a time point t6. Since the detection output shifts from the ON state to OFF state at the time point t6, the soft counting starts at the time point t6. At a time point t13 at which the count value of the soft counting reaches the soft-counting threshold value W corresponding to the predetermined consumption amount C, the controller starts ink supply (filling) to the sub tank 35.

In other words, if the detection output of the first sensor 251 continues to be in ON state for the predetermined time T1, it is assumed that a sufficient amount of ink is consumed and the displacement member 205 is in the sensor ON state or has moved to a position near the outer edge 205*a*. Such a configuration can prevent the soft counting from starting near the inner edge 205*b*, thus preventing ink leakage from the recording head.

Next, a second exemplary embodiment of the present disclosure is described with reference to FIG. 18.

Figure 18:
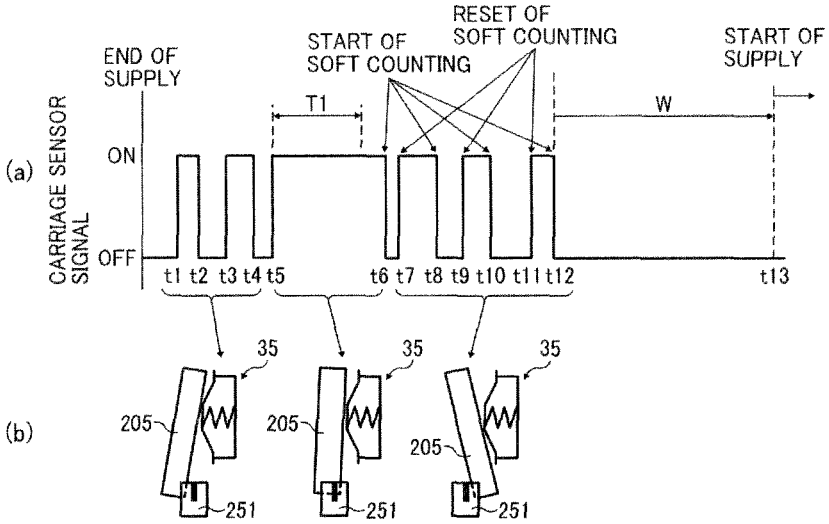
FIG. 18 shows, in a second exemplary embodiment of this disclosure, (a) a detection output of a first sensor detecting a displacement member and a start timing of measurement of the consumption amount of ink and (b) a relationship between the first sensor and positions of the displacement member.

FIG. 18 shows an example of the detection of the displacement member with the first sensor and the start timing of measuring the consumption amount of ink in this exemplary embodiment.

In this exemplary embodiment, when the detection output of the first sensor 251 shifts to ON state again after the start of soft counting, the controller rests the count value of the soft counting. Then, when the detection output of the first sensor 251 shifts from the ON state to OFF state, the controller starts the soft counting again. Such reset and restart of the soft counting are repeated.

Figure 19:
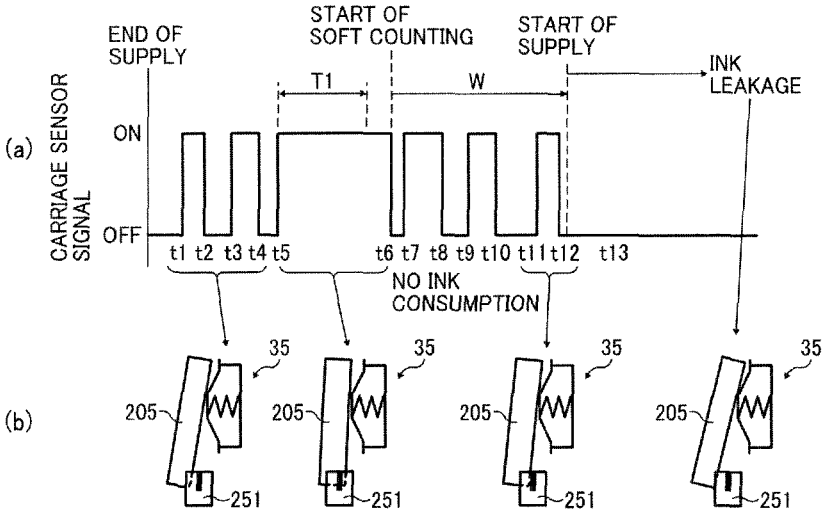
FIG. 19 shows (a) a detection output of a first sensor detecting a displacement member and a start timing of measurement of the consumption amount of ink and (b) a relationship between the first sensor and positions of the displacement member, in a comparative example in which control operation in the second exemplary embodiment is not performed.

In other words, as illustrated in FIG. 19, as with the above-described first exemplary embodiment, if the displacement member 205 fluctuates near the inner edge 205*b* after the soft counting starts at the time point t6, for example, the detection output of the first sensor 251 might shift from OFF state to ON state at time points t7, t9, and t11 and from ON state to OFF state at time points t8, t10, and t12.

At this time, if ejection failure occurs in some nozzles and the soft counting is not reset, for example, the controller might determine that the count value of the soft counting has reached the predetermined consumption amount (soft-counting threshold value W) even though the inner edge 205*b* of the displacement member 205 is placed at a position at which the remaining amount of liquid in the sub tank 35 is greater than the position detected with the first sensor 251. As a result, ink supply might start, thus causing ink leakage from the recording head.

Hence, in this second exemplary embodiment, as illustrated in FIG. 18, when the detection output of the first sensor 251 shifts to ON state at the time points t7, t9, and t11, the controller rests the soft counting. When the detection output of the first sensor 251 shifts from ON state to OFF state at the time points t8, t10, and t12, the controller restarts the soft counting. At the time point t13 at which the count value of the soft counting starting from the time point t12 reaches the soft-counting threshold value W, ink supply starts.

In this regard, if the displacement member 205 fluctuates near the inner edge 205*b* after the start of the soft counting, the displacement member 205 fluctuates in a state in which the ON state of the first sensor 251 is dominant. As a result, since the detection output of the first sensor 251 shifts to OFF state before the count value of the soft counting reaches the soft-counting threshold value W, the soft counting is reset. While the reset of the soft counting is repeated, the outer edge 205*a* of the displacement member 205 approaches the first sensor 251. As a result, the soft counting starts from the normal detecting position (detection timing) of the outer edge 205*a*, thus preventing ink leakage.

Next, an example of setting of the predetermined time T1 is described below.

In this example, the differential supply amount is controlled based on the differential supply time t.

The predetermined time T1 is a period of time during which the first sensor 251 is in ON state continuously from the end of the differential supply time t [s] without detecting the outer edge 205*a* of the displacement member 205 (shift from ON state to OFF state). To prevent erroneous detection of the inner edge 205*b*, the predetermined time T1 is preferably a maximum possible value or may be a variable corresponding to the differential supply time t [s].

Figure 20:
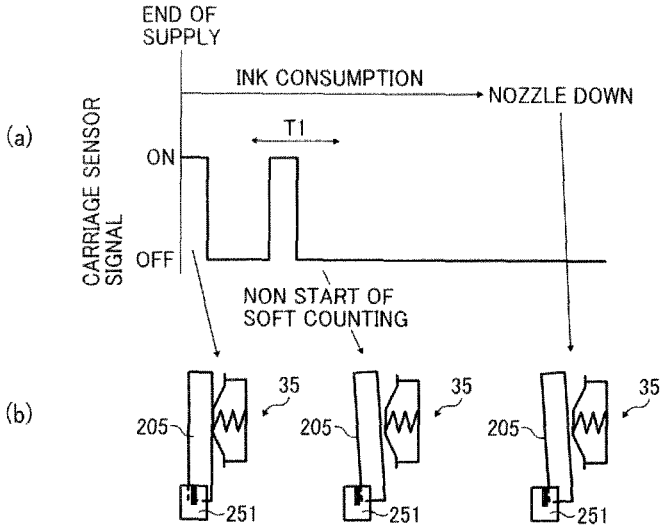
FIG. 20 shows, in a comparative example, (a) a detection output of a first sensor detecting a displacement member and setting of a predetermined time T1 and (b) a relationship between the first sensor and positions of the displacement member.

In such a case, if the predetermined time T1 is too long, as illustrated in FIG. 20, in a case in which the coverage rate is high and the ink ejection amount is large, the first sensor 251 detects the outer edge 205*a* of the displacement member 205 before the predetermined time T1 elapses from the end of ink supply. As a result, the soft counting could not start and ink consumption would continue, thus resulting in nozzle down (a state in which ink cannot be ejected from nozzles).

Hence, in this exemplary embodiment, the predetermined time T1 is set as described above, thus preventing the nozzle down.

Simply, the predetermined time T1 can be expressed by an equation of $T1=(f-e)\times t/e$, where "C" represents minimum flow amount and "e" represents maximum ejection amount.

Whether or not the predetermined time T1 has passed is preferably determined based on a continuous cumulative time in a monitoring range of the displacement member in carriage operation.

In other words, since the displacement member 205 fluctuates due to the scanning of the carriage 33, in particular, the fluctuation amount increases when the carriage 33 accelerates or decelerates, monitoring the displacement member 205 in all of the moving range of the carriage would hamper removal of chattering.

Hence, in this exemplary embodiment, a main scanning region of the carriage 33 in which the amplitude of the displacement member 205 is relatively stable and smaller than a certain width is set to the monitoring range of the displacement member. The controller determines whether or not the predetermined time T1 has passed in the monitoring range of the displacement member, thus removing influences of chattering. The stable area of the displacement member is typically an area in which the carriage moves at constant speed. However, the displacement member may be detected in acceleration and deceleration areas in which the amplitude of the displacement member is smaller than a certain amplitude.

Next, a third exemplary embodiment of the present disclosure is described with reference to FIG. 21.

Figure 21:
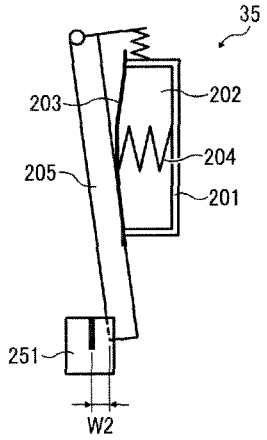
FIG. 21 is a schematic view of a sub tank and a first sensor in a third exemplary embodiment of this disclosure.

FIG. 21 is a schematic view of the third exemplary embodiment.

In this exemplary embodiment, when, at the end of printing, the count value of the consumption amount of ink by soft counting is equal to or greater than a second threshold value which is smaller than the threshold value corresponding to the predetermined liquid consumption amount, ink supply from the main tank 10 to the sub tank 35 starts.

For example, as illustrated in FIG. 21, ink supply starts when the count value is equal to or greater than a soft-counting value W2 (second soft-counting threshold value) which is smaller than the soft-counting threshold value W (first soft-counting threshold value).

In such a case, too, as described above, after the first sensor 251 detects the displacement member 205, ink is supplied to the sub tank by the differential supply amount (differential supply amount B or differential supply time t).

As a result, even if the count value does not reach the soft-counting threshold value W but is the second soft-counting threshold value W2 or greater, ink is filled to the sub tank after the end of printing, thus allowing printing to start immediately after the next printing job is received.

The ink supply at the end of printing can be performed after the carriage 33 returns to the standby position (i.e., the home position opposing the maintenance device 81) or while the carriage 33 is returning to the standby position. After the carriage 33 returns to the standby position, the displacement member 205 does not fluctuate, thus allowing more reliable ink supply. Alternatively, ink supply during return of the carriage 33 to the standby position can eliminate time loss.

The ink supply at the end of printing can also be performed only when the detection output of the first sensor 251 is in OFF state.

In other words, in a case in which the consumption amount of ink is the second soft-counting threshold value or greater when the carriage 33 is stopped, if ink supply starts with the first sensor 251 in ON state, the shift from OFF state to ON state is not detected, thus resulting in oversupply. Hence, as described above, ink may be supplied only when the detection output of the first sensor 251 is in OFF state, thus preventing oversupply of ink.

Next, a fourth exemplary embodiment of the present disclosure is described with reference to FIG. 22.

Figure 22:
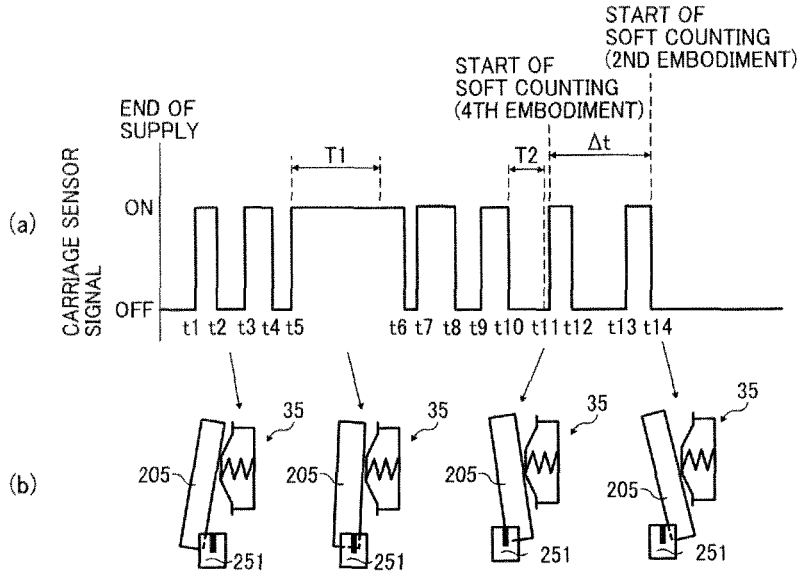
FIG. 22 shows, in a fourth exemplary embodiment of this disclosure, (a) a detection output of a first sensor detecting a displacement member and a start timing of measurement of the consumption amount of ink and (b) a relationship between the first sensor and positions of the displacement member.

FIG. 22 shows an example of the detection of the displacement member with the first sensor and the start timing of measuring the consumption amount of ink in this exemplary embodiment.

In this exemplary embodiment, as illustrated in (a) of FIG. 22, soft counting starts after a predetermined time T1 (referred to as "first predetermined time T1" in this exemplary embodiment) passes, the detection output of the first sensor 251 shifts from ON state to OFF state, and the OFF state continues for a second predetermined time T2.

For example, in (a) of FIG. 22, after the first predetermined time T1 passes, the detection output of the first sensor 251 shifts from ON state to OFF state at time points t6 and t8. By contrast, soft counting does not start in periods between the time point t6 and a time point t7 and between the time point t8 and a time point t9 since each of the periods is shorter than the second predetermined time T2. Then, the detection output of the first sensor 251 shifts from OFF state to ON state at the time point t9 and shifts from ON state to OFF state at the time point t10. Since the OFF state continues for the second predetermined time T2, soft counting starts from a time point t11 at which the detection output of the first sensor 251 shifts from OFF state to ON state.

According to such control process, since the first predetermined time T1 has passed and the displacement member 205 fully moves from the inner edge 205*b* to the outer edge 205*a* relative to the first sensor 251, if the detection output of to the first sensor 251 continues to be in OFF state for the second predetermined time T2, it is assumed that the detection output of to the first sensor 251 has shifted to OFF state by the outer edge 205*a* of the displacement member 205. Such control process can prevent ink leakage without resetting the count value of soft counting each time the detection output shifts from OFF state to ON state as in the second exemplary embodiment.

As illustrated in (a) of FIG. 22, for example, when the detection output shifts to ON state at a time point t13 later than the time point t11 and shifts to OFF state at a time point t14, for the above-described second exemplary embodiment, the soft counting is reset at the time point t13 and restarted from the time point t14.

Thus, according to this exemplary embodiment, ink supply can start earlier (by a time Δ illustrated in FIG. 22) than the control of repeating reset of the soft counting, which is more advantageous than the second exemplary embodiment in that a narrower range of negative pressure can be set in this fourth exemplary embodiment.

Each of the above-described exemplary embodiments is described taking an example of the control of starting the measurement of the liquid consumption amount after a predetermined time T has passed. It is to be noted that the measurement of the liquid consumption amount may be started after the ON state is continuously detected for a predetermined number of times N.

In other words, in such a case, as another exemplary embodiment corresponding to the above-described first exemplary embodiment, soft counting may be started after the detection output of the first sensor 251 is continuously in ON state for the predetermined number of times N and shifts from ON state to OFF state. This is because it is determined that, if the detection output of the first sensor 251 is continuously in ON state for the predetermined number of times N and shifts from ON state to OFF state, the position of the displacement member 205 relative to the first sensor 251 has sufficiently moved from the inner edge 205*b* to the outer edge 205*a*.

In addition, as another exemplary embodiment corresponding to the above-described second exemplary embodiment, soft counting may be started after the detection output of the first sensor 251 is continuously in ON state for the predetermined number of times N and shifts from ON state to OFF state. Then, when the detection output of the first sensor 251 shifts from OFF state to ON state, the controller resets the count value of the soft counting, and when the detection output of the first sensor 251 shifts from ON state to OFF state, the controller restarts the soft counting The setting of the predetermined number of times N is performed in a way similar to the setting of the predetermined time T1. For the third exemplary embodiment, without changes, the measurement of the liquid consumption amount can be started after a predetermined number of times N of shift between ON state and OFF state.

Furthermore, as another exemplary embodiment corresponding to the above-described fourth exemplary embodiment, substantially the same processing can be performed by setting a first predetermined number of times N1 and a second predetermined number of times N2 corresponding to the first predetermined time T1 and the second predetermined time T2, respectively.

Next, another example of the arrangement of the first and second sensors is described with reference to FIG. 23.

In the following description, the sub tank 35 is referred to as "head tank 35".

Figure 23:
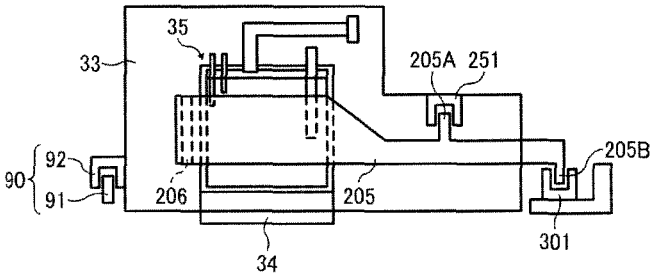
FIG. 23 is a schematic view of another example of arrangement of the first and second sensors.

In the example illustrated in FIG. 23, the displacement member 205 of the head tank 35 has detected portions 205A and 205B projecting upward and downward, respectively, at positions away by different distances from the support shaft 206 (pivot axis). The first sensor 251 on the carriage 33 detects the detected portion 205A, and the second sensor 301 on the apparatus body detects the detected portion 205B.

Next, a fifth exemplary embodiment of the present disclosure is described below.

First, a comparative example in which soft counting is not started by ink supply operation during printing and fluctuations of the displacement member is described with reference to FIG. 24.

Figure 24:
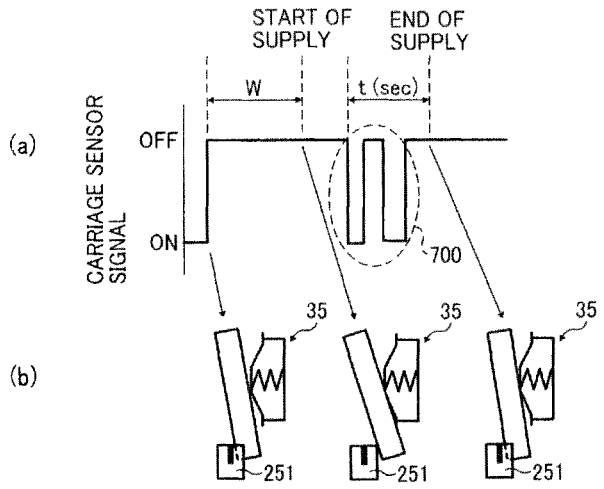
FIG. 24 shows (a) a detection output of a first sensor detecting a displacement member and (b) a relationship between the first sensor and positions of the displacement member, in a comparative example in which soft counting is not started due to ink supply during printing and fluctuations of the displacement member.

As illustrated in FIG. 24, when the detection output of the first sensor 251 shifts from ON state to OFF state and detects the outer edge 205*a* of the displacement member 205, soft counting is started. When the count value of the soft counting reaches a threshold value W, ink supply to the head tank 35 is started. After the detection output of the first sensor 251 shifts from OFF state to ON state, the detection output of the first sensor 251 may repeatedly shift between ON state and OFF state (as indicated by an area 700) while the liquid feed pump 241 is driven for a differential supply time t [sec]. (In FIG. 24, positions of ON state and OFF state are opposite to those in FIG. 22.)

One reason of the repeated shift is that, because, during printing, ink is supplied to the head tank 35 while ink of the head tank 35 is consumed, when the supply amount of ink is small and the consumption amount of ink is large, the effective increasing amount of ink in the head tank 35 per unit time becomes an amount obtained by subtracting the consumption amount from the supply amount. Another reason is that, as described above, the displacement member 205 fluctuates due to movement of the carriage 33.

As a result, when the liquid feed pump 241 is driven for the differential supply time t and the ink supply to the head tank 35 ends, the displacement member 205 is placed at a position at which the remaining amount of liquid in the head tank 35 is smaller than the position at which the displacement member 205 is detected the first sensor 251, thus causing the OFF state of the detection output of the first sensor 251.

In such a state, even though ink of the head tank 35 is consumed thereafter, the detection output of the first sensor 251 remains in OFF state. As a result, soft counting (measurement of the consumption amount of ink) does not start. Consequently, ink of the head tank 35 continues to be consumed and the nozzle down (ejection failure) due to shortage of ink supply to the recording head 34, thus resulting in degraded image quality.

Hence, in this fifth exemplary embodiment, the start processing of soft counting is changed depending on whether the differential supply amount is a predetermined value or greater.

In this fifth exemplary embodiment, since the differential supply amount is controlled by the differential supply time t, the predetermined value is set in unit of time (i.e., the time corresponding to the predetermined value is referred to as "predetermined value t22"). The predetermined value 122 is described below with reference to FIG. 25.

The predetermined value t22 is a driving time of the liquid feed pump 241 for which the liquid feed pump 241 supplies ink by an amount not more than a supply amount corresponding to the width of the displacement member 205 in its displacement direction (feeler thickness). In other words, when ink supply to the head tank 35 is started from the state illustrated in (a) of FIG. 25, at a stage of the differential supply time t=0, as illustrated in (b) of FIG. 25, the detection output of the first sensor 251 shifts from OFF state to ON state.

Figure 25:
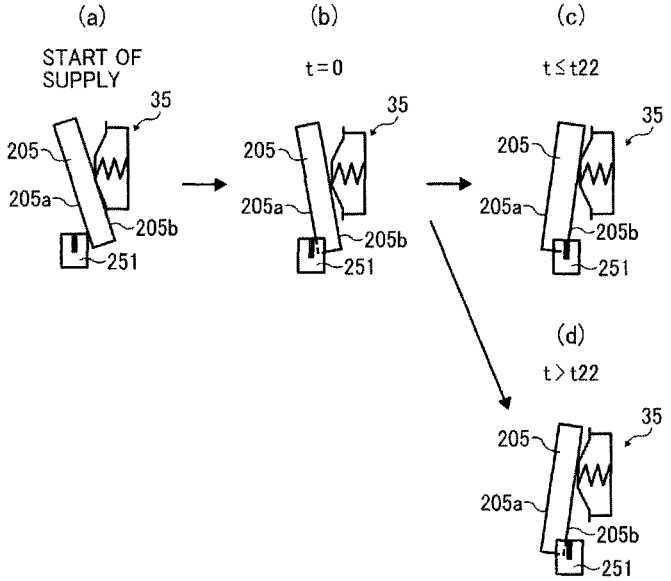
FIG. 25 shows, in a fifth exemplary embodiment of this disclosure, a displacement member at (a) a supply start position, (b) a soft-counting start position at which a differential supply time t is zero, (c) a position at which the differential supply time t is not greater than a predetermined time t22, and (d) a position at which the differential supply time t is greater than the predetermined time t22.

When ink supply is continued by the predetermined value t22 from the state of (b) of FIG. 25, as illustrated in (c) of FIG. 25, the inner edge 205*b* of the displacement member 205 does not pass fully. In other words, the predetermined value 122 is a period of time during which the inner edge 205*b* of the displacement member 205 is not detected by the first sensor 251 when ink supply is continued after detection of the outer edge 205*a* with the first sensor 251.

By contrast, when ink supply is continued for a time greater than the predetermined value t22, as illustrated in (d) of FIG. 25, the inner edge 205*b* of the displacement member 205 fully passes the first sensor 251 and the inner edge 205*b* of the displacement member 205 is detected by the first sensor 251.

By setting the predetermined value t22 as described above, the detection output of the first sensor 251 shifts between ON state and OFF state based on only the outer edge 205*a* serving as a reference portion of the displacement member 205. As a result, soft counting is not started when the detection output is in OFF state at the inner edge 205*b* side, thus preventing supply error and ink leakage.

In this regard, when t>t22 (the differential supply amount is greater than the threshold value), the inner edge 205*b* of the displacement member 205 fully passes the first sensor 251 and the detection output shifts to OFF state. As a result, since the detection output of the first sensor 251 also repeatedly shifts between ON state and OFF state at the inner edge 205*b* side, it may be necessary to determine which of the inner edge 205*b* and the outer edge 205*a* is detected by the first sensor 251. A process to deal with such a situation is described below in an exemplary embodiment described below (eighth exemplary embodiment).

Figure 26:
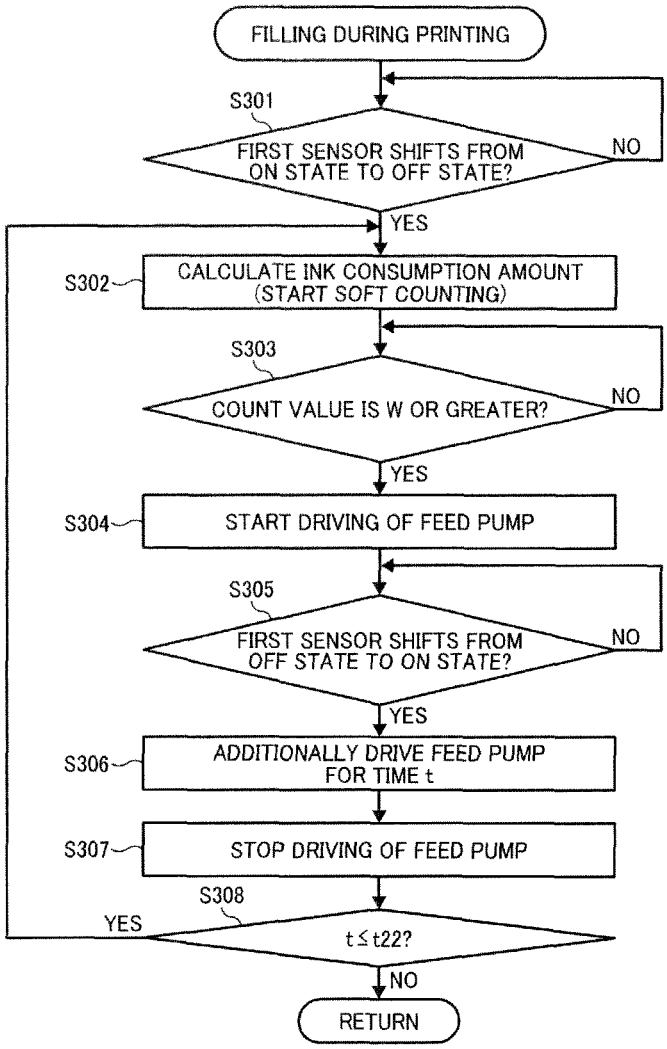
FIG. 26 is a flowchart of a procedure of ink filling control during printing in the fifth exemplary embodiment of this disclosure.

Next, ink filling control during printing in this fifth exemplary embodiment is described with reference to FIG. 26.

When the detection output of the first sensor 251 shifts from ON state to OFF state during printing (YES at S301), at S302 the controller starts soft counting to calculate the consumption amount of ink in the head tank 35. When the count value of the soft counting is a threshold value W or greater (YES at S303), at S304 the liquid feed pump 241 is driven for forward rotation to start ink tilling to the head tank 35.

When the detection output of the first sensor 251 shifts from OFF state to ON state (YES at S305), at S306 the liquid feed pump 241 further continues ink filling for a differential supply time t [sec] and at S307 the controller stops driving of the liquid feed pump 241.

At S308, the controller determines whether or not the differential supply time t is a predetermined value t22 or less (i.e., the differential supply amount is the predetermined value or lower).

When the differential supply time t is the predetermined value t22 or less (YES at S308), the controller starts soft counting of the consumption amount of ink.

By contrast, when the differential supply time t is greater than the predetermined value t22, the process goes back to the start of this procedure and the controller does not start soft counting of the consumption amount of ink. When the detection output of the first sensor 251 shifts from ON state to OFF state, at S302 the controller starts the soft counting.

As described with reference to FIG. 24, due to a lower differential supply amount than an ink consumption amount or fluctuations of the displacement member 205, at the end of ink supply by the differential supply amount, the displacement member 205 may be placed at a position at which the remaining amount of liquid in the head tank 35 is smaller than the position at which the displacement member 205 is detected with the first sensor 251, and the detection output of the first sensor 251 may be in OFF state. Even in such a case, the above-described control process can start the soft counting (measurement of the consumption amount of ink), thus preventing nozzle down (ejection failure) and degraded image quality.

Figure 27:
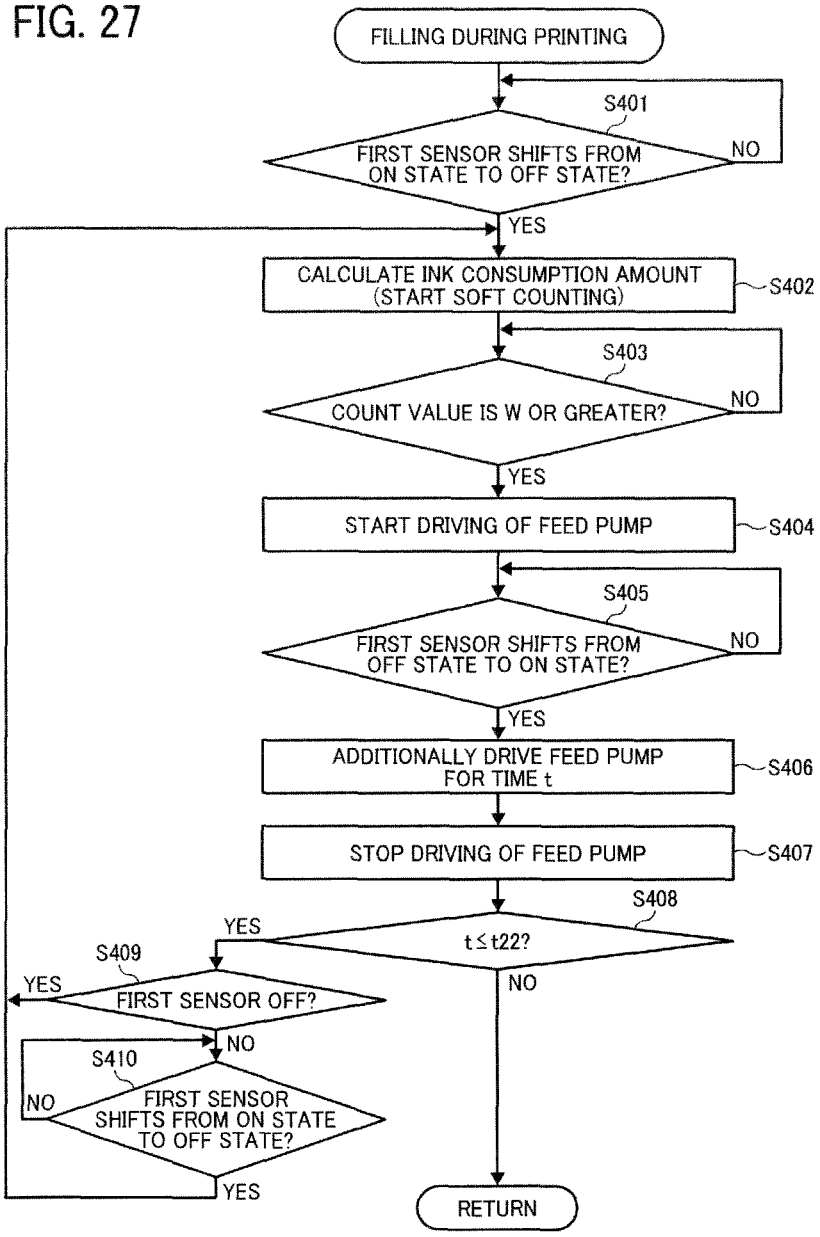
FIG. 27 is a flowchart of a procedure of ink filling control during printing in a sixth exemplary embodiment of this disclosure.

Next, a sixth exemplary embodiment of the present disclosure is described with reference to FIG. 27.

In this sixth exemplary embodiment, as in the above-described fifth exemplary embodiment, after stopping driving of the liquid feed pump 241 at S407, at S408 the controller determines whether or not the differential supply time t is the predetermined value t22 or less (the differential supply amount is the predetermined value or less).

When the differential supply time t is the predetermined value t22 or less (YES at S408), at S409 the controller determines whether or not the detection output of the first sensor 251 is in OFF state.

When the detection output of the first sensor 251 is in OFF state (YES at S409), the controller starts soft counting of the consumption amount of ink.

By contrast, when the detection output of the first sensor 251 is not in OFF state (is in ON state) (NO at S409), at S410 the controller determines whether or not the detection output of the first sensor 251 shifts from ON state to OFF state. When the detection output of the first sensor 251 shifts from ON state to OFF state (YES at S410), at S402 the controller starts soft counting of the consumption amount of ink.

Alternatively, when the differential supply time t is greater than the predetermined value t22, as in the fifth exemplary embodiment, the process goes back to the start of this procedure and the controller does not start soft counting of the consumption amount of ink. When the detection output of the first sensor 251 shifts from ON state to OFF state, the controller starts the soft counting.

In other words, in the above-described fifth exemplary embodiment, when the differential supply time t is the predetermined value t22 or less, soft counting is started even if the detection output of the first sensor 251 is in ON state. As a result, when the count value of the soft counting reaches a threshold value W with the detection output of the first sensor 251 being in ON state, ink supply is started. Then, if ink is supplied for the differential supply time t while using the shift from OFF state to ON state as a trigger for stopping ink supply, the ink supply might be continued without pulling the trigger, thus causing ink leakage.

Hence, in this sixth exemplary embodiment, only when the differential supply time t is the predetermined value t22 or less and the detection output of the first sensor 251 is in OFF state (does not detect the displacement member 205), the controller starts soft counting immediately after stopping the liquid feed pump. When the count value of the soft counting reaches the soft-counting threshold value with the detection output of the first sensor 251 being in ON state, the controller starts ink supply, thus preventing ink leakage.

Figure 28A:
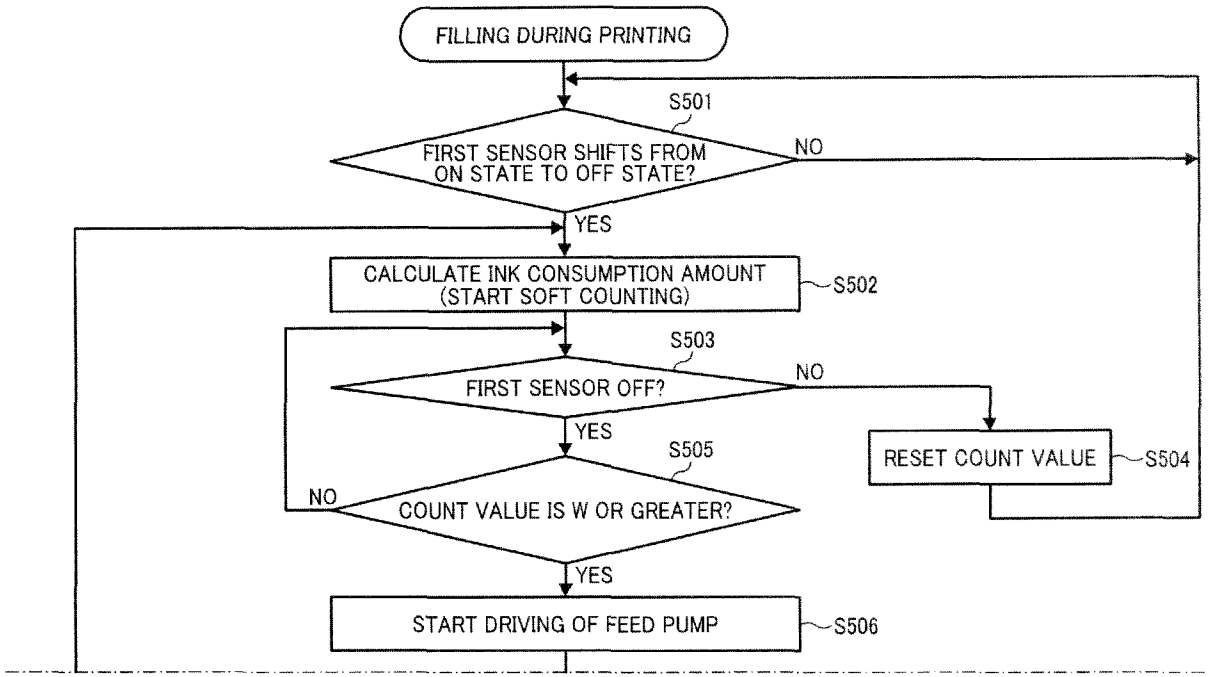
FIGS. 28A and 28B are a flowchart of a procedure of ink filling control during printing in a seventh exemplary embodiment of this disclosure.
Figure 28B:
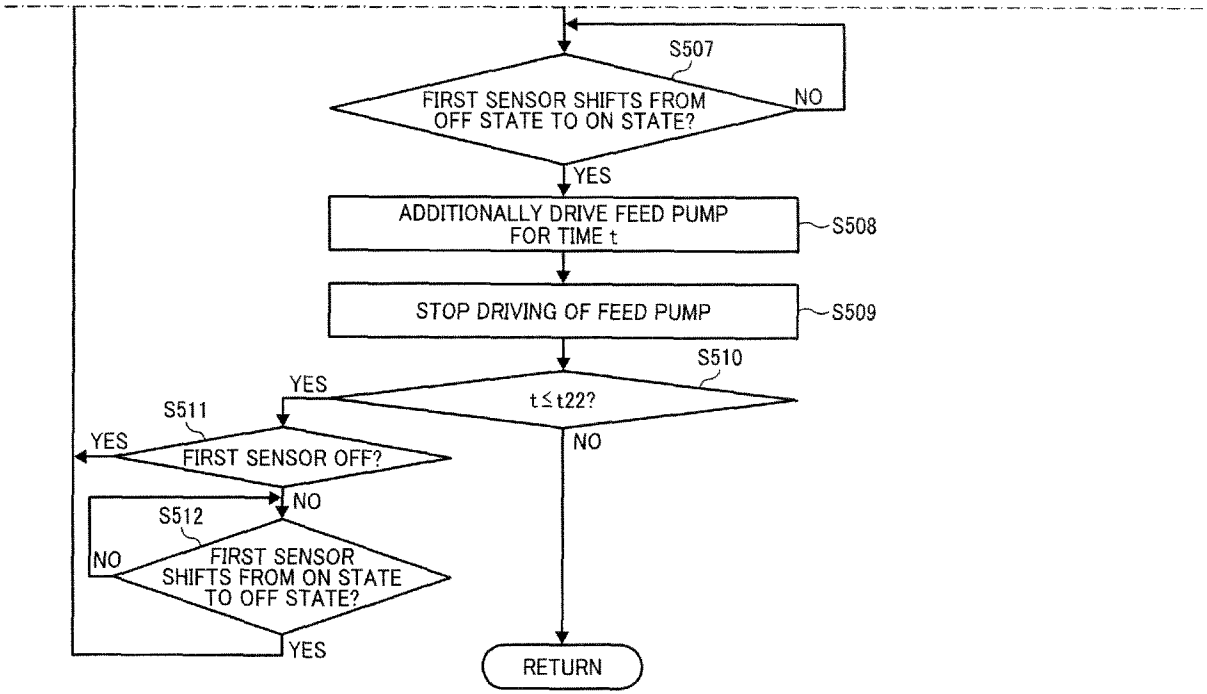

Next, a seventh exemplary embodiment of the present disclosure is described with reference to FIGS. 28A and 28B.

This seventh exemplary embodiment differs from the sixth exemplary embodiment in that, after the detection output of the first sensor 251 shifts from ON state to OFF state (YES at S501) and the controller starts soft counting (S502), at S503 the controller determines whether or not the detection output of the first sensor 251 is in OFF state.

When the detection output of the first sensor 251 is in OFF state (YES at S503), at S505 the controller determines whether or not the count value of the soft counting reaches a threshold value W. By contrast, when the detection output of the first sensor 251 is not in OFF state, i.e., turns into ON state again (NO at S503), at S504 the controller resets the count value of the soft counting to zero and the process goes back to the processing of S501 to determine whether or not the detection output of the first sensor 251 shifts from ON state to OFF state. The configuration of this exemplary embodiment is applicable to any of the above-described exemplary embodiments.

Such a configuration can prevent liquid leakage even if the first detector is in ON state (detects the displacement member) when the count value of soft counting reaches the soft-counting threshold value W (supply start position) due to fluctuations of the displacement member or detection error of the first detector.

In addition, for such a configuration, even if the displacement member fluctuates, the soft counting (measurement of the consumption amount of ink) is started from a position at which the first detector does not detect the displacement member. As a result, ink is consumed up to a lower limit of the head tank, thus increasing the ink supply amount of the liquid feed pump per operation and the product life of the pump.

Figure 29A:
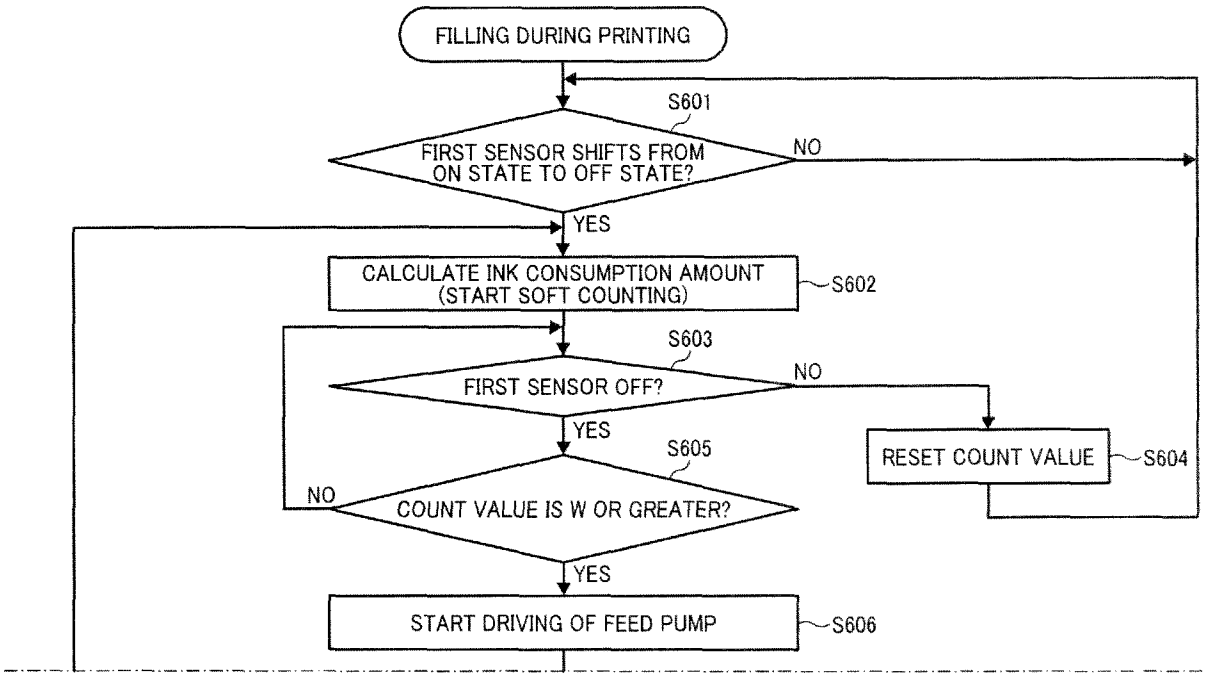
FIGS. 29A and 29B are a flowchart of a procedure of ink filling control during printing in an eighth exemplary embodiment of this disclosure.
Figure 29B:
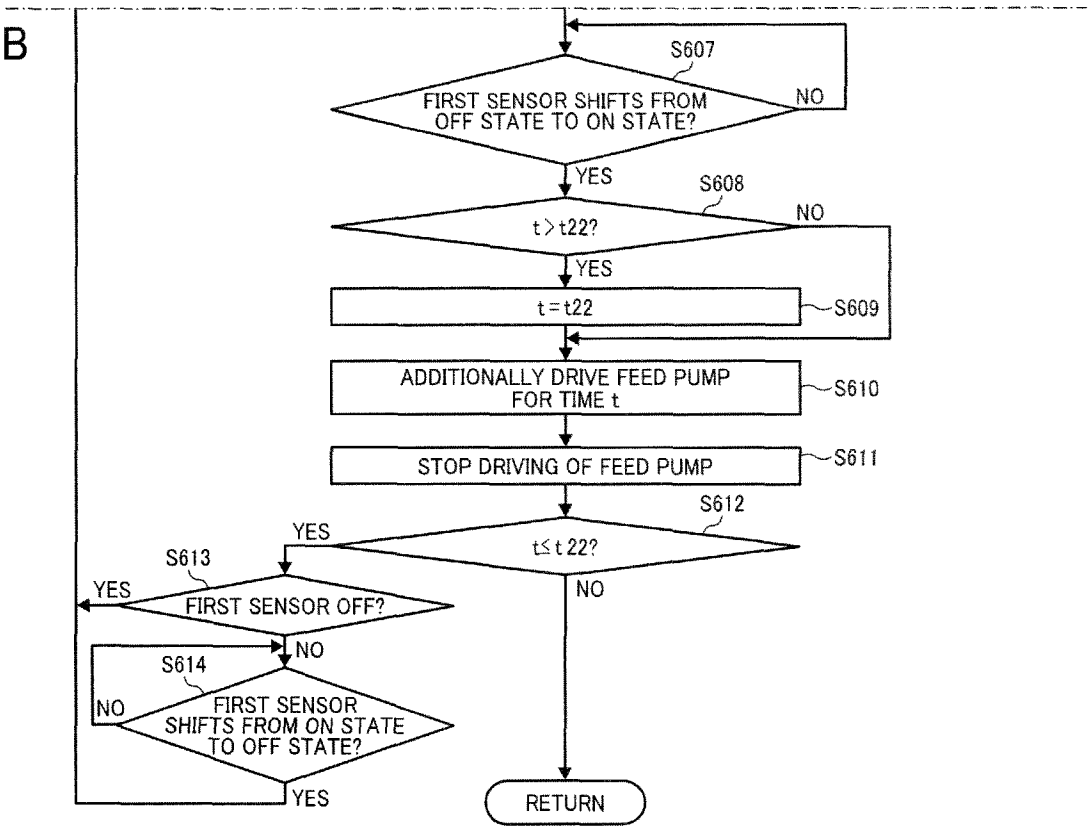

Next, an eighth exemplary embodiment of the present disclosure is described with reference to FIGS. 29A and 29B.

This eighth exemplary embodiment differs from the above-described seventh exemplary embodiment (or any other exemplary embodiment) in that, after at S606 the liquid feed pump 241 stops droving and at S607 the detection output of the first sensor 251 shifts from OFF state to ON state, at S608 the controller determines whether or not the differential supply time t is greater than the predetermined value 122 (the differential supply amount is greater than the predetermined value).

When the differential supply time t is greater than the predetermined value t22 (YES at S608), at S609 the controller resets the differential supply time t to the predetermined value t22.

In other words, as described above, when the differential supply time t is greater than the predetermined value t22, the inner edge 205*b* of the displacement member 205 moves to a position at which the remaining amount of liquid in the head tank 35

Hence, according to this eighth exemplary embodiment, ink supply operation during printing can be controlled between the ON state of the detection output obtained when the first detector detects the displacement member 205 and the OFF state of the detection output obtained when the first detector detects the outer edge 205*a* of the displacement member 205. Such a configuration prevents losing sight of the position of the displacement member 205, thus facilitating the control.

Figure 30:
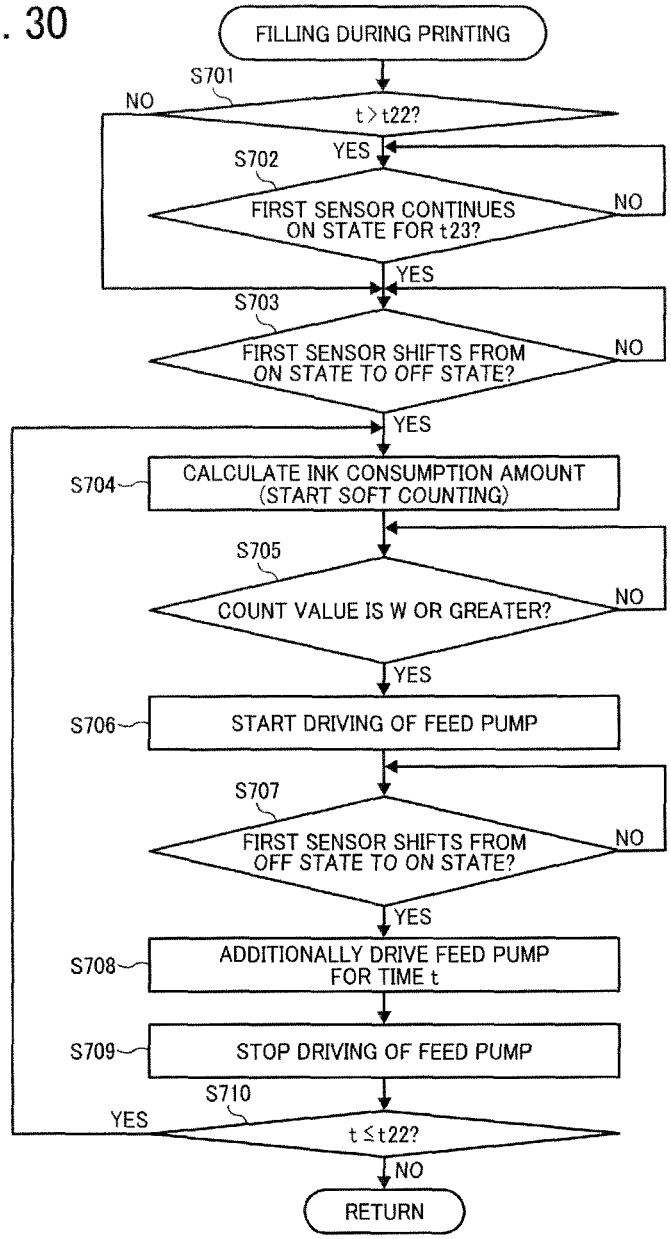
FIG. 30 is a flowchart of a procedure of ink filling control during printing in a ninth exemplary embodiment of this disclosure.

Next, a ninth exemplary embodiment of the present disclosure is described with reference to FIG. 30.

This ninth exemplary embodiment differs from the first exemplary embodiment in that, before determining whether or not the detection output of the first sensor 251 shifts from ON state to OFF state (S703), at S701 the controller determines whether or not the differential supply time t is greater than the predetermined value t22. When the differential supply time t is greater than the predetermined value t22 (YES at S701), at S702 the controller determines whether or not the detection output of the first sensor 251 is in ON state continuously for a time 23. If the detection output of the first sensor 251 is in ON state continuously for a time 23 (YES at S702), at S703 the controller determines whether or not the detection output of the first sensor 251 shifts from ON state to OFF state.

In other words, if the differential supply time t is greater than the predetermined value t22, the controller starts soft counting for calculating the consumption amount of ink when the detection output of the first sensor 251 shifts from ON state to OFF state after the first sensor 251 continues to be in ON state for a predetermined time (time t23). If, during the soft counting, the detection output of the first sensor 251 shifts from OFF state to ON state again, as in the above-described seventh exemplary embodiment, the controller preferably resets the soft counting value to zero and determines whether or not the detection output of the first sensor 251 shifts from ON state to OFF state again.

In other words, as described above, if the differential supply amount (differential supply time t) is large, the detection output may shift to OFF state at the inner edge 205*b* side of the displacement member 205. Therefore, it may be necessary to prevent the soft counting from starting when, due to chattering of the displacement member 205, the detection output shifts from ON state to OFF state at the inner edge 205*b* side.

Hence, if the detection output of the first sensor 251 is in ON state continuously for the predetermined time (t23), it is assumed that ink is sufficiently consumed and the displacement member 205 has moved to a position at which the sensor is in ON state or near the outer edge 205*a*. Such a configuration prevents soft counting from starting near the inner edge 205*b*, thus preventing liquid leakage.

In addition, setting the differential supply amount to be as large as possible can increase the supply amount of ink of the liquid feed pump per operation, thus increasing the product life of the pump.

In this exemplary embodiment, as described above, the controller determines whether or not ON state continues for the predetermined time (t23). Alternatively, for example, the controller may determine whether or not ON state is continuously detected for a predetermined number of times. In such a case, after ON state is continuously detected for the predetermined number of times, the controller may determine whether or not the detection output of the first sensor 251 shifts from ON state to OFF state, and start soft counting when the detection output of the first sensor 251 shifts from ON state to OFF state.

Next, a tenth exemplary embodiment of the present disclosure is described below.

In this tenth exemplary embodiment, regarding the differential supply amount, the above-described predetermined value t22 (referred to as "first predetermined value t22" in this exemplary embodiment) and a second predetermined value t24 at which the differential supply amount is greater than at the first predetermined value t22 are set as predetermined values.

When the differential supply time t is greater than the first predetermined value t22 and less than the second predetermined value t24 ($t22<t<t24$), as in the above-described eighth exemplary embodiment, the differential supply time t is changed to the first predetermined value t22.

By contrast, when the differential supply time t is the second predetermined value t24 or greater ($t\geq t24$), as in the above-described ninth exemplary embodiment, the controller determines whether or not the detection output of the first sensor 251 is in ON state continuously for a predetermined time t23. After the detection output of the first sensor 251 is in ON state continuously for the predetermined time t23, the controller starts soft counting when the detection output of the first sensor 251 shifts from ON state to OFF state. If, during the soft counting, the detection output of the first sensor 251 shifts from OFF state to ON state again, as in the above-described seventh exemplary embodiment, the controller preferably resets the soft counting value to zero and determines whether or not the detection output of the first sensor 251 shifts from ON state to OFF state again.

In other words, when the differential supply time t is less than the second predetermined time t24, the inner edge 205*b* may not be detected (OFF state) at the end of ink supply or the outer edge 205*a* may not be detected (OFF state) before detection of the elapse of the predetermined time t23, thus resulting in nozzle down or liquid leakage.

Hence, when the differential supply time t is greater than t22 and less than t24 (t22<t<t24), the differential supply time t is corrected to t22 to prevent failures. When the differential supply time t is t24 or greater (t≥t24), a large differential supply amount can be set by waiting the elapse of the predetermined time t23.

Next, an eleventh exemplary embodiment of e present disclosure is described below.

As described above, the displacement member 205 of the head tank 35 fluctuates due to the scanning operation of the carriage 33. In particular, the fluctuation amount increases when the carriage 33 accelerates or decelerates. Then, if supply control is performed by detecting displacement of the displacement member 205 all over the carriage operation area during printing operation, chattering of the displacement member 205 might cause nozzle down or liquid leakage.

Hence, in this exemplary embodiment, during the main scanning operation of the carriage 33, the first sensor 251 detects the displacement member 205 in an area (referred to as "feeler stable area") in which the amplitude of the displacement member 205 is not greater than a predetermined acceptable width.

Here, an example of the relationship between the carriage speed and the amplitude of the displacement member 205 (feeler amplitude) is described with reference to FIG. 31.

A feeler stable area (stable area of the displacement member) is typically an area in which the carriage moves at a constant speed. Alternatively, the displacement member may be detected by the first sensor 251 in acceleration and deceleration areas of the carriage 33 in which the amplitude of the displacement member is smaller than a certain amplitude or when the carriage 33 is stopped.

Figure 31:
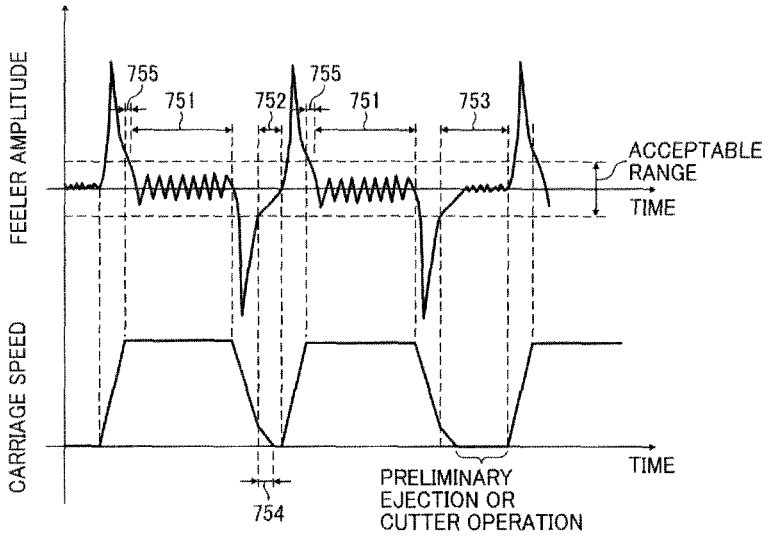
FIG. 31 is a chart of an example of relationship between carriage speed and amplitude of the displacement member (feeler amplitude) in an eleventh exemplary embodiment of this disclosure.

In the example of FIG. 31, the feeler stable area includes a constant speed area 751 and portions 752 and 753 of deceleration and stop areas. Since the feeler amplitude might become greater than the feeler acceptable amplitude in a portion 755 of the constant speed area (in which overshoot might occur in the end of acceleration), the portion 755 is omitted from the feeler stable area, When preliminary ejection (dummy ejection) or cutter operation is performed, the carriage 33 stops for a time 753 longer than a regular stop time. As a result, the fluctuations of the displacement member 205 stabilize, thus allowing the time 753 to be used as the feeler stable area. In such a case, only when a stop time of the carriage 33 is longer than a predetermined time, the stop time may be used as the feeler stable area. The cutter operation shown in FIG. 31 represents a period of time for which, when this exemplary embodiment is applied to an image forming apparatus capable of printing a continuous sheet, the image forming apparatus cuts the continuous sheet.

The feeler stable area including portions of the acceleration, deceleration, and stop areas is preferably an area 752 between a time point preceding to the stop point of the carriage for a predetermined time (distance) 754 and an acceleration start point. In other words, in a case in which the carriage 33 is stopped by two-stage deceleration, the displacement member 205 is less likely to fluctuate in a period of time from a deceleration time immediately before stop to a time immediately before the start of acceleration, thus allowing the period to be used as the feeler stable area.

Next, an example of the relationship between fluctuations of the displacement member 205 and printing modes is described with reference to FIG. 32.

In this example, a high speed mode prioritizing speed over image quality and a fine mode (high quality mode) with a lower speed than the high speed mode are shown as printing modes. That is, regarding the speed of the carriage 33, the high speed mode indicated by a solid line and the fine mode indicated by a broken line in FIG. 32 are used.

For the moving speed of the carriage 33, the constant speed and the acceleration speed are different between the printing modes, and the fluctuations of the displacement member 205 vary with the constant or acceleration speed of the carriage. Hence, in this exemplary embodiment, the feeler stable area is set in accordance with the printing modes (the constant or acceleration speed of the carriage).

Figure 32:
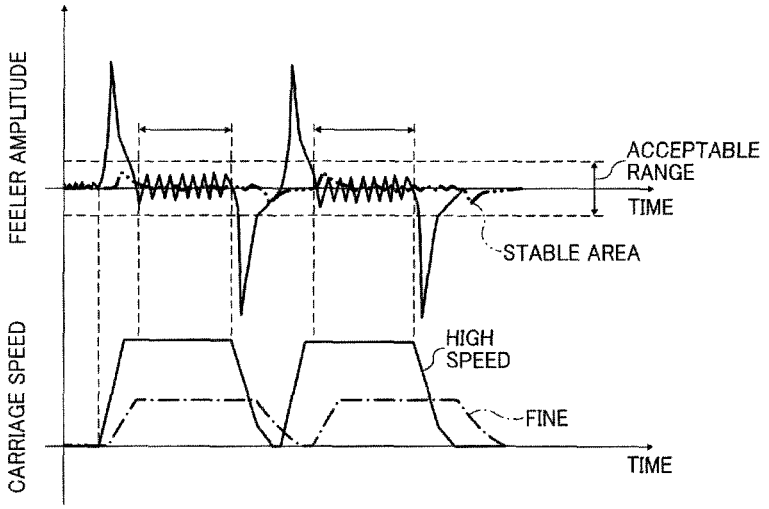
FIG. 32 is a chart of an example of relationship between fluctuations of the displacement member and printing modes in the eleventh exemplary embodiment.

For example, in FIG. 32, for the high speed mode, a portion of the constant speed area is usable as the feeler stable area, By contrast, for the fine mode, the entire constant speed area is usable as the feeler stable area. For the tine mode, the carriage speed is lower, and the ejection flow amount of ink is likely to be small. Since the fluctuations of the displacement member are less at a lower carriage speed, the feeler stable area can extend. On the other hand, since the ejection flow amount of ink is small and ink supply shortage is less likely to occur, the feeler stable area may be set to be narrow to enhance the reliability.

Figure 33:
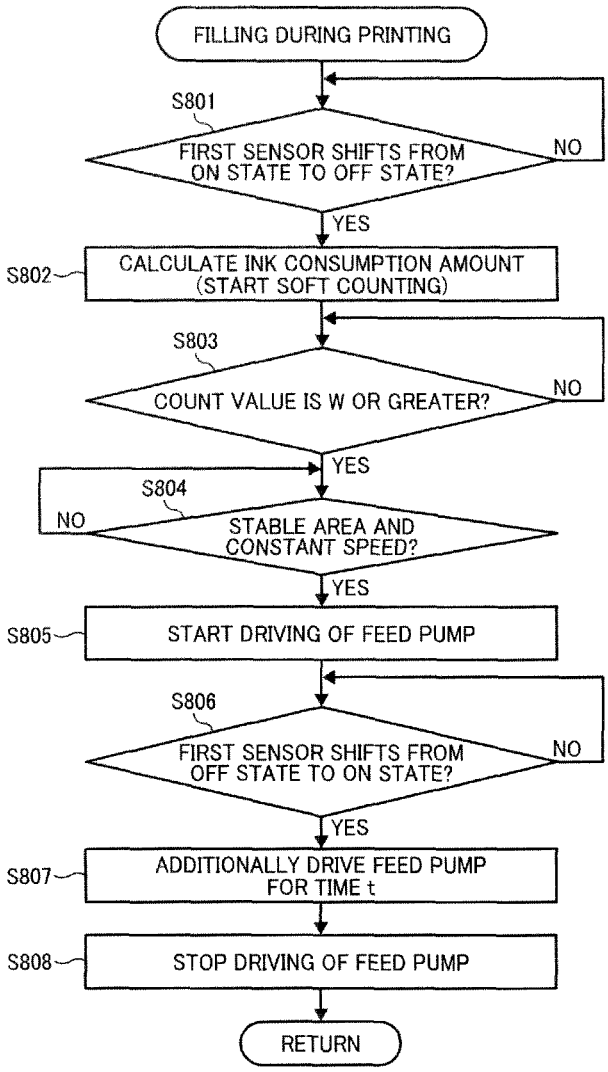
FIG. 33 is a flowchart of a procedure of ink tilling control during printing in the eleventh exemplary embodiment of this disclosure.

Next, ink filling control during printing in this eleventh exemplary embodiment is described with reference to FIG. 33.

When the detection output of the first sensor 251 shifts from ON state to OFF state during printing (YES at S801), at S802 the controller starts soft counting to calculate the consumption amount of ink in the head tank 35. When the count value of the soft counting is a threshold value W or greater (YES at S803), at S804 the controller determines whether or not the feeler amplitude is in the feeler stable area and the carriage speed is in a constant speed area.

When the feeler amplitude is in the feeler stable area and the carriage speed is in a constant speed area (YES at S804), at S805 the controller starts driving the liquid feed pump 241 for forward rotation to fill ink to the head tank 35. When the detection output of the first sensor 251 shifts from OFF state to ON state (YES at S806), at S807 the liquid feed pump 241 further continues ink filling for a differential supply time t [sec] and at S808 the controller stops driving of the liquid feed pump 241.

By contrast, when the feeler amplitude is not in the feeler stable area or the carriage speed is not in a constant speed area (NO at S804), the controller stands by without starting the forward rotation of the liquid feed pump 241 until the feeler amplitude is in the feeler stable area and the carriage speed is in a constant speed area.

In other words, in this exemplary embodiment, even when the feeler amplitude is in the feeler stable area, at portions of the acceleration, deceleration, and stop areas, the controller does not use detection results of the first sensor 251 to operate the liquid feed pump 241.

In such a case, if the feeler amplitude is in the feeler stable area and the carriage speed is in a portion of the acceleration, deceleration, and stop areas, for example, the controller can perform a control operation (e.g., the reset of soft counting) other than the control operation of the liquid feed pump. For such a configuration, even if the amplitude of the displacement member 205 suddenly increases in an acceleration or deceleration area, the controller performs only the reset of soft counting without operating the liquid feed pump 241, thus preventing liquid leakage or nozzle down.

Figure 34:
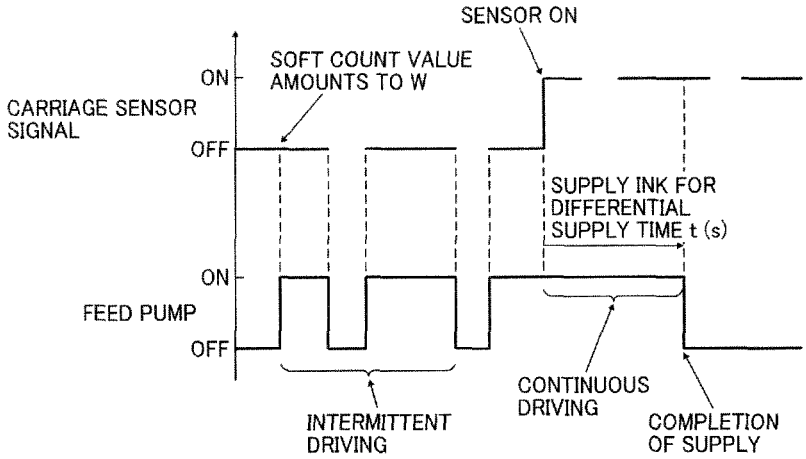
FIG. 34 is a chart of a carriage sensor signal and a driving signal of a liquid feed pump in a twelfth exemplary embodiment of this disclosure.

Next, a twelfth exemplary embodiment of e present disclosure is described with reference to FIG. 34.

In this exemplary embodiment, in a period between the start of driving of the liquid feed pump 241 and the detection of the displacement member 205 with the first sensor 251 (turning ON of the first sensor 251) after the soft-counting value of the consumption amount of ink reaches the threshold value W, the controller intermittently drives the liquid feed pump 241 for intermittent ink supply outside the feeler stable area. After the detection of the displacement member 205 (turning ON of the first sensor 251), ink is continuously supplied for the differential supply time t regardless of whether or not the feeler amplitude is in the feeler stable area.

As described above, when ink supply is performed while monitoring the position of the displacement member 205, inks is supplied only in the feeler stable area, thus preventing a detection error due to fluctuations of the displacement member 205. By contrast, when ink is supplied by a differential supply amount without monitoring the position of the displacement member 205, ink supply can be continuously performed, thus allowing efficient ink supply and minimizing influence to the durability of the liquid feed pump.

The above-described various types of control (processing) for supplying ink to the sub tank (head tank) are performed by a computer in accordance with programs stored in, e.g., the ROM 502. The programs can be downloaded into the information processing device (host 600) and installed to the image forming apparatus. For example, the image forming apparatus according to any of the exemplary embodiments of this disclosure may be combined with an information processing device to form an image forming system. Alternatively, an image forming apparatus may be combined with an information processing device including the programs for the control (processing) according to any exemplary embodiment of this disclosure.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A method for controlling an image forming apparatus comprising a sub tank to store liquid to be supplied to a recording head, a carriage mounting the recording head and the sub tank, a main tank to store the liquid to be supplied to the sub tank, a liquid feed device to supply the liquid from the main tank to the sub tank, and a displacement member provided at the sub tank and displaceable with a remaining amount of the liquid in the sub tank, the method comprising:

detecting, by a first detector mounted on the carriage, a first position of the displacement member;

detecting, by a second detector mounted on the apparatus body, a second position of the displacement member;

detecting and retaining, by a detection retainer, a differential supply amount corresponding to a first displacement amount of the displacement member between the first position and the second position or a second displacement amount obtained by subtracting a predetermined displacement amount from the first displacement amount;

providing a liquid consumption amount measuring device to receive a detection output of the first detector and measure a consumption amount of the liquid in the sub tank when the displacement member displaces from the first position in a direction in which the consumption amount of the liquid in the sub tank decreases;

starting, by a supply controller, supply of the liquid from the main tank to the sub tank without using the second detector, when the consumption amount of the liquid measured by the liquid consumption amount measuring device reaches a predetermined threshold value, and supplying the liquid by the differential supply amount after the first detector detects the displacement member; and controlling by the supply controller, when the first position of the displacement member is detected with the first detector, and the remaining amount of the liquid in the sub tank is smaller than when the second position of the displacement member is detected with the second detector, the liquid consumption amount measuring device to start measuring the consumption amount of the liquid in the sub tank, after a detection output of the first detector continues to be, for a predetermined time, in a detection state in which the first detector detects the displacement member, then shifts from the detection state to a non detection state in which the first detector does not detect the displacement member, and continues to be in the non detection state for a second predetermined time.

2. The method of claim 1, wherein, when the detection output of the first detector shifts from the non detection state to the detection state after the liquid consumption amount measuring device starts measuring the consumption amount of the liquid, the liquid consumption amount measuring device resets a measurement result of the consumption amount of the liquid and, when the detection output of the first detector shifts from the detection state to the non detection state, the liquid consumption amount measuring device starts measuring the consumption amount of the liquid.

3. The method of claim 1, wherein, the predetermined time is set to be a time such that the first detector does not detect shifting of the displacement member from the detection state to the non detection state after the liquid is supplied by the differential supply amount and at least before the detection output of the first detector continues to be in the detection state for the predetermined time.

4. The method of claim 1, wherein the supply controller determines whether or not the detection output of the first detector continues to be in the detection state for the predetermined time, based on a continuous cumulative time in a monitoring range of the displacement member during main scanning operation of the carriage, and the monitoring range of the displacement member is a stable area in which a fluctuation amount of the detection output, due to scanning of the carriage, is not greater than a predetermined fluctuation amount.

5. The method of claim 1, wherein, when, after printing, a measurement result of the consumption amount of the liquid is less than the predetermined threshold value and not less than a predetermined value, the supply controller supplies the liquid from the main tank to the sub tank.

6. The method of claim 1, wherein, after printing is finished, the supply controller supplies the liquid from the main tank to the sub tank after the carriage returns to a standby position or while the carriage is moving to the standby position.

7. A method for controlling an image forming apparatus comprising a sub tank to store liquid to be supplied to a recording head, a carriage mounting the recording head and the sub tank, a main tank to store the liquid to be supplied to the sub tank, a liquid feed device to supply the liquid from the main tank to the sub tank, and a displacement member provided at the sub tank and displaceable with a remaining amount of the liquid in the sub tank, the method comprising:

detecting, by a first detector mounted on the carriage, a first position of the displacement member;

detecting, by a second detector mounted on the apparatus body, a second position of the displacement member;

detecting and retaining, by a detection retainer, a differential supply amount corresponding to a first displacement amount of the displacement member between the first position and the second position or a second displacement amount obtained by subtracting a predetermined displacement amount from the first displacement amount;

providing a liquid consumption amount measuring device to receive a detection output of the first detector and measure a consumption amount of the liquid in the sub tank when the displacement member displaces from the first position in a direction in which the consumption amount of the liquid in the sub tank decreases;

starting, by a supply controller, supply of the liquid from the main tank to the sub tank without using the second detector, when the consumption amount of the liquid measured by the liquid consumption amount measuring device reaches a predetermined threshold value, and supplying the liquid by the differential supply amount after the first detector detects the displacement member; and controlling by the supply controller, when the first position of the displacement member is detected with the first detector, and the remaining amount of the liquid in the sub tank is smaller than when the second position of the displacement member is detected with the second detector, the liquid consumption amount measuring device to start measuring the consumption amount of the liquid in the sub tank, after detection output of the first detector continues to be, for a first predetermined time, in a detection state in which the first detector detects the displacement member, and then shifts from the detection state to a non detection state in which the first detector does not detect the displacement member.

8. A method for controlling an image forming apparatus comprising a head tank to store liquid to be supplied to a recording head, a carriage mounting the recording head and the head tank, a main tank to store the liquid to be supplied to the head tank, a liquid feed device to supply the liquid from the main tank to the head tank, and a displacement member provided at the head tank and displaceable with a remaining amount of the liquid in the head tank, the method comprising:

detecting, by a first detector mounted on the carriage, a first position of the displacement member; and detecting, by a second detector mounted on the apparatus body, a second position of the displacement member;

providing a supply controller (i) to control driving of the liquid feed device to supply the liquid from the main tank to the head tank, and (ii) to detect and retain a differential supply amount corresponding to a displacement amount of the displacement member between the first position and the second position, wherein when the first position of the displacement member is detected with the first detector, the remaining amount of the liquid in the head tank is smaller than when the second position of the displacement member is detected with the second detector;

measuring, by the supply controller, a consumption amount of the liquid in the head tank, when the liquid is supplied from the main tank to the head tank without using the second detector during printing operation, and starting, by the supply controller, supplying the liquid from the main tank to the head tank, when the consumption amount of the liquid reaches a predetermined threshold value at which a remaining amount of the liquid stored in the head tank is smaller than when the first detector detects the displacement member;

controlling, by the supply controller after the first detector detects the displacement member, the liquid feed device to supply the liquid by the differential supply amount from the main tank to the head tank;

starting, by the supply controller when the differential supply amount is less than a predetermined value, measuring the consumption amount of the liquid in the head tank at end of supplying the liquid by the differential supply amount; and starting, by the supply controller when the differential supply amount is not less than the predetermined value, measuring the consumption amount of the liquid in the head tank after supplying of the liquid by the differential supply amount ends and a detection output of the first detector shifts from a detection state in which the first detector detects the displacement member to a non detection state in which the first detector does not detect the displacement member.

9. The method of claim 8, wherein, when the differential supply amount is less than the predetermined value, at end of supplying the liquid by the differential supply amount, the supply controller determines whether or not the first detector detects the displacement member, when the first detector does not detect the displacement member, the supply controller starts measuring the consumption amount of the liquid in the head tank at end of supplying the liquid by the differential supply amount, and when the first detector detects the displacement member, the supply controller starts measuring the consumption amount of the liquid in the head tank after the detection output of the first detector shifts from the detection state to he non detection state.

10. The method of claim 8, wherein the displacement member comprises a detected portion having a predetermined width in a displacement direction in which the displacement member displaces, and the predetermined value is not greater than a supply amount of the liquid supplied by the liquid feed device from the main tank to the head tank to displace the displacement member by the width of the detected portion of the displacement member in the displacement direction of the displacement member.

11. The method of claim 10, wherein, when the supply controller starts measuring the consumption amount of the liquid and the detection output of the first detector shifts from the non detection state to the detection state, the supply controller resets a measurement value, and when the detection output of the first detector shifts from the detection state to the non detection state, the supply controller restarts measuring the consumption amount of the liquid.

12. The method of claim 8, wherein, when the differential supply amount is greater than the predetermined value, the supply controller changes the differential supply amount to the predetermined value.

13. The method of claim wherein, when the differential supply amount is greater than the predetermined value, the supply controller starts measuring the consumption amount of the liquid at a point at which, after the detection output of the first detector continues to be in the detection state for a predetermined time, the detection output of the first detector shifts from the detection state to the non detection state.

14. The method of claim 8, wherein, when the differential supply amount is greater than a first predetermined value and less than a second predetermined value that is greater than the first predetermined value, the supply controller changes the differential supply amount to the first predetermined value, and when the differential supply amount is greater than the second predetermined value, the supply controller starts measuring the consumption amount of the liquid at a point at which, after the detection output of the first detector continues to be in the detection state for a predetermined time, the detection output of the first detector shifts from the detection state to the non detection state.

15. The method of claim 8, wherein, when, with movement of the carriage, the displacement member swings along a movement direction of the carriage and speed of the carriage is in a stable area in which a fluctuation amount of the detection output, due to scanning of the carriage, is not greater than a predetermined fluctuation amount, the first detector detects the displacement member.

16. The method of claim 15, wherein the first detector detects the displacement member when the carriage is accelerated or decelerated, and the supply controller performs a control operation other than a driving control of the liquid feed device based on a detection result of the first detector.

17. The method of claim 8, wherein, when the consumption amount of the liquid reaches the predetermined threshold value and the supply controller starts supplying the liquid from the main tank to the head tank, in a period from start of supplying the liquid to detection of the displacement member with the first detector, the supply controller intermittently drives the liquid feed device in a stable area of the displacement member in which a fluctuation amount at which the displacement member fluctuates when the carriage is accelerated or decelerated is not greater than a predetermined fluctuation amount, and in a period from when the first detector detects the displacement member to when the liquid is supplied by the differential supply amount, the supply controller continuously drives the liquid feed device regardless of whether the displacement member is in the stable area.

* * * * *